US008444189B2

(12) United States Patent
Jitsuishi et al.

(10) Patent No.: US 8,444,189 B2
(45) Date of Patent: May 21, 2013

(54) DOOR OPEN/CLOSE SYSTEM FOR A VEHICLE

(75) Inventors: Norifumi Jitsuishi, Shizuoka (JP); Hironori Matsumoto, Shizuoka (JP); Takahiro Kan, Aichi (JP); Takashi Adachi, Oita (JP); Motomu Imaizumi, Aichi (JP)

(73) Assignees: Yazaki Corporation, Tokyo (JP); Toyota Auto Body Co., Ltd., Kariya-shi (JP)

( * ) Notice: Subject to any disclaimer, the term of this patent is extended or adjusted under 35 U.S.C. 154(b) by 571 days.

(21) Appl. No.: 12/516,284

(22) PCT Filed: Nov. 22, 2007

(86) PCT No.: PCT/JP2007/073124

§ 371 (c)(1), (2), (4) Date: May 26, 2009

(87) PCT Pub. No.: WO2008/072484

PCT Pub. Date: Jun. 19, 2008

(65) Prior Publication Data

US 2010/0064588 A1 Mar. 18, 2010

(30) Foreign Application Priority Data

Dec. 7, 2006 (JP) ..... 2006-330921
Dec. 7, 2006 (JP) ..... 2006-330922

(51) Int. Cl.
*E05C 3/06* (2006.01)
*E05C 3/00* (2006.01)

(52) U.S. Cl.
USPC ..... 292/201; 292/216; 292/DIG. 23

(58) Field of Classification Search
USPC ..... 292/201, 216, DIG. 23
See application file for complete search history.

(56) References Cited

U.S. PATENT DOCUMENTS 5,603,537 A * 2/1997 Amano et al. ..... 292/201
5,713,613 A * 2/1998 Honma et al. ..... 292/201

(Continued)

FOREIGN PATENT DOCUMENTS

FR 2 807 778 A1 10/2001
FR 2 860 023 A1 3/2005

(Continued)

OTHER PUBLICATIONS

Japanese Office Action issued for Japanese Patent Application No. 2006-330921 dated Jun. 28, 2011, and English translation.

(Continued)

*Primary Examiner* — Carlos Lugo
(74) *Attorney, Agent, or Firm* — Kratz, Quintos & Hanson, LLP

(57) ABSTRACT

A door open/close system for a vehicle includes: a plurality of door open/close devices 11, 11' having a latch mechanism 14 including a latch 13 for engaging with an engaging member 12, a motor 16*a* (16*a*') for driving the latch mechanism 14, and a latch state detecting member 21 (21'); and a control member 4 for starting to drive the motor of any one of all the door open/close device when the latch state detecting member of the one door open/close devices detects that the latch mechanism is in the half-latch state, said control member driving synchronously the motors of all the door open/close devices except the one door open/close device to change the latch mechanisms from the half-latch state to the full-latch state when the latch state detecting members of all the door open/close devices except the one door open/close device detect that the latch mechanisms are in the half-latch state in a case that the door of the vehicle is changed from a fully opened state to a fully closed state.

4 Claims, 16 Drawing Sheets

U.S. PATENT DOCUMENTS

| | | | | |
|---|---|---|---|---|
| 5,722,272 | A * | 3/1998 | Bridgeman et al. | 70/264 |
| 6,109,079 | A * | 8/2000 | Ikeda | 70/264 |
| 6,499,776 | B2 * | 12/2002 | Takamura | 292/201 |
| 6,519,987 | B1 * | 2/2003 | Weyerstall | 70/257 |
| 6,698,804 | B2 * | 3/2004 | Shiota et al. | 292/201 |
| 6,848,727 | B1 * | 2/2005 | Cetnar et al. | 292/201 |
| 6,964,438 | B2 * | 11/2005 | Koike et al. | 292/201 |
| 6,974,165 | B2 * | 12/2005 | Koike et al. | 292/216 |
| 7,185,459 | B2 * | 3/2007 | Fronz et al. | 49/449 |
| 7,234,737 | B2 * | 6/2007 | Kalsi | 292/201 |
| 2005/0110279 | A1 * | 5/2005 | Kalsi | 292/144 |
| 2006/0049643 | A1 * | 3/2006 | Roussel | 292/216 |

FOREIGN PATENT DOCUMENTS

| | | | |
|---|---|---|---|
| GB | 2 320 943 | A | 7/1998 |
| JP | 11-321336 | | 11/1999 |
| JP | 2000-314258 | | 11/2000 |
| JP | 2002-250163 | A1 | 9/2002 |
| WO | WO 02/068782 | A1 | 9/2002 |

OTHER PUBLICATIONS

International Search Report for International Application No. PCT/JP2007/073124 dated Apr. 7, 2008.

Japanese Office Action issued for Japanese Patent Application No. 2006-330921 dated Sep. 13, 2011, and English translation.

* cited by examiner

DOOR OPEN/CLOSE SYSTEM FOR A VEHICLE

TECHNICAL FIELD

Conventionally, a vehicle 1 such as a wagon or a minivan includes a flip-up rear door 2 as shown in FIG. 17A or includes an upper flip-up rear door 2 and a lower flip-down rear door 3 as shown in FIG. 17B.

BACKGROUND

In the vehicle 1 shown in FIG. 17B, the upper door 2 is allowed to open when the lower door 3 is closed, and the rear door 3 is allowed to open or close when the upper door 2 is open. Further, when opening the lower door 3 while the upper door 2 is open, as shown in FIG. 18, firstly locking mechanisms 400 at both sides are unlocked by operating a release lever 500 of the lower door 3, then the lower door 3 is manually opened. When closing the lower door 3, the locking mechanism 400 is locked by manually closing and pushing the lower door 3.

The rear door 3 described above is manually opened and closed. However, a door open/close method in which the locking mechanism of the rear door is locked/unlocked by controlling and driving a motor is known (for example, Patent Document 1).

[Patent Document 1] Japanese Published Patent Application No. 2002-250163

DISCLOSURE OF THE INVENTION

Problem to be Solved by the Invention

According to the door manually open/close system described above, because a force to operate the release lever and a force to push the lower door to lock the locking mechanism are needed, there is a burden of labor for a user. Further, when the lock is incomplete due to the insufficient pushing of the door, it is difficult for the user to know the incomplete locking. Further, the door manually open/close system lacks a high-class feeling.

Further, the above-described door open/close system using the motor only use a single motor. When using a plurality of motor for coping with a larger door, there are problems that the door may not smoothly open/close and random motor driving noises may reduce the quality.

Accordingly, an object of the present invention is to provide a door open/close system for a vehicle that can easily and surely open/close the door with a plurality of motors.

Means for Solving Problem

For attaining the object, according to claim 1 of the present invention, there is provided a door open/close system for a vehicle for fully opening and fully closing the door including:

a plurality of door open/close devices mounted on a door or a body of the vehicle, each of said door open/close devices having a latch mechanism for engaging with an engaging member mounted on the door or the body so as to be in a half-latch state or a full-latch state, a motor for driving the latch mechanism, and a latch state detecting member; and a control member for starting to drive synchronously all the motors of the door open/close devices to change the latch mechanisms from the half-latch state to the full-latch state when all the detecting members of the door open/close devices detect that the latch mechanisms are in the half-latch state in a case that the door of the vehicle is changed from a fully opened state to a fully closed state.

According to the present invention as claimed in claim 1, the door open/close system for a vehicle includes the door open/close devices mounted on a door or a body of the vehicle, and the control member for controlling the door open/close devices. Each door open/close device includes the latch mechanism for engaging with the engaging member mounted on the door or the body so as to be in the half-latch state or the full-latch state, the motor for driving the latch mechanism, and the latch state detecting member. The control member drives synchronously all the motor of the door open/close devices to change the latch mechanisms from the half-latch state to the full-latch state when all the detecting members of the door open/close devices detect that the latch mechanisms are in the half-latch state in a case that the door of the vehicle is changed from a fully opened state to a fully closed state. Accordingly, because the door of the vehicle is easily and surely opened or closed with a plurality of motors, the burden of labor for a user is decreased, and a half-shut door is prevented. Further, because the door does not start fully closing until all the door open/close devices are in the half-latch state when the door is changed from the fully open state to the fully closed state, catching a user with the door, which is one of reasons to be a half-shut door, is prevented and a safety of a human body is secured. Further, because a plurality of motors is synchronously driven, a smooth feeling like a single motor is realized, and a sense of incompatibility is not experienced. Further, because a plurality of motors is surely synchronously driven, a drift of motor sound in a long time is prevented, and the door open/close system works with a smaller noise.

For attaining the object, according to claim 2 of the present invention, there is provided the door open/close system for a vehicle as claimed in claim 1, wherein the control member starts to drive the motor of any one of all the door open/close devices when the latch state detecting member of the one door open/close device detects that the latch mechanism is in the half-latch state, and the control member starts to drive synchronously the motors of all the door open/close devices except the one door open/close device to change all the latch mechanisms from the half-latch state to the full-latch state when the latch state detecting members of all the door open/close devices detect that the latch mechanisms are in the half-latch state in a case that the door of the vehicle is changed from a fully opened state to a fully closed state.

According to the present invention as claimed in claim 2, the door open/close system for a vehicle includes the door open/close devices mounted on a door or a body of the vehicle, and the control member for controlling the door open/close devices. Each door open/close device includes the latch mechanism for engaging with the engaging member mounted on the door or the body so as to be in the half-latch state or the full-latch state, the motor for driving the latch mechanism, and the latch state detecting member. The control member starts driving the motor of all the door open/close devices when the detecting member of the one door open/close device detects that the latch mechanism is in the half-latch state, and drives synchronously the motors of all the door open/close devices except the one door open/close device to change the latch mechanisms from the half-latch state to the full-latch state when all the detecting members of the door open/close devices detect that the latch mechanisms are in the half-latch state in a case that the door of the vehicle is changed from a fully opened state to a fully closed state. Accordingly, because the door of the vehicle is easily and surely opened or closed with a plurality of motors, the burden of labor for a user is decreased, and a half-shut door is prevented. Further, a smooth synchronous control in consideration of user's safety is done, and the vehicle door can be surely fully closed. Further, as the number of the door open/close devices increases, user's burden of labor decreases. Further, because the conventional door open/close device can be used without changing as the synchronously controlled device, cost of the door open/close system for a vehicle decreases.

For attaining the object, according to claim 3 of the present invention, there is provided the door open/close system for a vehicle as claimed in claim 2, wherein when the latch state detecting member of the one door open/close device detects that the latch mechanism is in the half-latch state, the control member starts an assist operation to make all the latch mechanisms in the half-latch state by driving the motors of all the door open/close devices except the motor of the one door open/close device.

For attaining the object, according to claim 4 of the present invention, there is provide the door open/close system for a vehicle as claimed in claim 2, wherein when the motor of at least one of the other door open/close devices except said one door open/close device is not started before the latch state detecting member of said one door open/close device detects that the latch mechanism is in the full-latch state, the control member returns all the door open/close devices to the state previous to the start of driving of the motors.

According to the present invention as claimed in claim 4, the control member returns all the door open/close devices to the state previous to the start of driving of the motors when the motor of at least one of the other door open/close devices except said one door open/close device is not started before the latch state detecting member of said one door open/close device detects that the latch mechanism is in the full-latch state. Accordingly, when a trouble is occurred such as catching something in the vehicle door, the fully closing operation can be prevented.

For attaining the object, according to claim 5 of the present invention, there is provided the door open/close system for a vehicle as claimed in claim 2 or claim 4, further comprising an open instruction signal outputting member for outputting an open instruction signal to the control member when the door is changed from the fully closed state to the fully opened state, wherein corresponding to an input of the open instruction signal from the open instruction signal outputting member, the control member synchronously starts driving all the motors of the door/open close devices to change each latch mechanism from the half-latch state to the full-latch state.

According to the present invention as claimed in claim 5, the door open/close system for a vehicle further includes the open instruction signal outputting member for outputting the open instruction signal to the control member when the door is changed from the fully closed state to the fully opened state. Corresponding to the input of the open instruction signal from the open instruction signal outputting member, the control member synchronously starts driving all the motors of the door/open close devices to change each latch mechanism from the half-latch state to the full-latch state. Accordingly, because the motors are surely synchronously driven when fully opening the fully closed door, the drift of the motor sound in the long time is prevented, and the door open/close system works with a smaller noise. Therefore, a high-quality door open/close system for a vehicle can be provided.

Effect of the Invention

According to the present invention as claimed in claim 1, because the door of the vehicle is easily and surely opened or closed with a plurality of motors, the burden of labor for a user is decreased, and a half-shut door is prevented. Therefore, operability and user convenience are increased. Further, because the door does not start fully closing until all the door open/close devices are in the half-latch state when the door is changed from the fully open state to the fully closed state, catching a user with the door, which is one of reasons to be a half-shut door, is prevented and a safety of a human body is secured. Further a trouble or a deformation of a vehicle caused by catching something with the door is prevented. Further, because a plurality of motors is synchronously driven, the smooth feeling like a single motor is realized, and the sense of incompatibility is not experienced. Therefore, a high-quality door open/close system for a vehicle can be realized. Further, because a plurality of motors is surely synchronously driven, a drift of motor sound in a long time is prevented, and the door open/close system works with a smaller noise. Therefore, the high-quality door open/close system for a vehicle can be provided.

According to the present invention as claimed in claim 2, because the door of the vehicle is easily and surely opened or closed with a plurality of motors, the burden of labor for a user is decreased, and a half-shut door is prevented. Further, a smooth synchronous control in consideration of user's safety is done, and the vehicle door can be surely fully closed. Further, as the number of the door open/close devices increases, user's burden of labor decreases. Further, because the conventional door open/close device can be used without changing as the synchronously controlled device, cost of the door open/close system for a vehicle decreases.

According to the present invention as claimed in claim 4, when a trouble is occurred such as catching something in the vehicle door, the fully closing operation can be prevented.

According to the present invention as claimed in claim 5, because the motors are surely synchronously driven when fully opening the fully closed door, the drift of the motor sound in the long time is prevented, and the door open/close system works with a smaller noise. Therefore, a high-quality door open/close system for a vehicle can be provided.

BEST MODE FOR CARRYING OUT THE INVENTION

Hereafter, a first embodiment of the present invention will be explained with reference to figures.

As shown in FIG. 1, a door open/close system for a vehicle according to the embodiment of the present invention is used for controlling open/close a lower door 3 of a rear door of a vehicle 1 composed of a flip-up upper door and a flip-down lower door. The door open/close system for a vehicle of the present invention includes two door open/close devices 11, 11' disposed at both sides of an inside of the lower door 3, and a handle switch button **30*a* disposed at a tip of the lower door 3**.

The lower door 3 is opened or closed manually by a user or automatically by the door open/close devices 11, 11' owing to an operation of the handle switch button **30*a*. Incidentally, the upper door is allowed to be opened or closed by another door open/close device disposed on an interior of the upper door when the lower door 3** is in a later-described fully closed state. However, an open/close control of the upper door is not included in this explanation, and a detailed explanation thereof is omitted.

Because each mechanical structure of two door open/close devices 11, 11' is similar to those disclosed in the Patent Document 1, only the door open/close device 11 will be explained with reference to the explanation and the figures of the Patent Document 1.

FIG. 2 is a block diagram showing an electric structure of the door open/close system for a vehicle according to the present invention. As shown in FIG. 2, the door open/close system for a vehicle is composed of the door open/close devices 11, 11' having the same structures, a control unit 4, and a handle switch 30.

The door open/close device 11 includes a motor 16*a*, a latch state detecting switch 21 (hereafter referred to as "latch switch 21"), and a neutral switch 29. The latch switch 21 includes a half-latch switch 21*a*, a full-latch switch 21*b*, and a courtesy switch 21*c*. The latch switch 21 corresponds to the latch state detecting member in claims.

The door open/close device 11' includes a motor 16*a'*, a latch state detecting switch 21' (hereafter referred to as "latch switch 21"), and a neutral switch 29'. The latch switch 21' includes a half-latch switch 21*a'*, a full-latch switch 21*b'*, and a courtesy switch 21*c'*. The latch switch 21' corresponds to the latch state detecting member in claims.

The control unit 4 includes a control/judging part 5, input circuits 6, 7, 8, and motor driving circuits 9, 10 each connected to the control/judging part 5. The control unit 4 corresponds to the control member in claims. The control/judging part 5 includes a judging part 5*a* and a control part 5*b*. The handle switch 30 is connected to the input circuit 6. The handle switch 30 corresponds to the open instruction signal outputting member.

The motor 16*a* of the door open/close device 11 is connected to the motor driving circuit 9. The latch switch 21 and the neutral switch 29 are connected to the input circuit 7. The motor 16*a'* of the door open/close device 11' is connected to the motor driving circuit 10. The latch switch 21' and the neutral switch 29' are connected to the input circuit 8. Incidentally, the control unit 4 can be composed of a microcomputer and the like.

Next, a mechanical structure of the door open/close device 11 will be explained. Incidentally, a detailed explanation of the door open/close device 11' having the same structure is omitted. Hereafter, when necessary, components of the door open/close device 11' will be explained by adding "'" to reference numbers of the components of the door open/close device 11.

FIG. 3 is a perspective schematic view showing the door open/close device 11. The door open/close device 11 includes a latch mechanism 14 having a latch 13 engaged with a striker 12 (only shown in FIG. 5) which is an engaging member fixed at on open side of the vehicle body closed by the lower door 3. Further, the door open/close device 11 includes an operating mechanism 15 for operating the latch mechanism 14, and a motor member 16 as an actuator for driving the operating mechanism 15. The motor member 16 includes the motor 16*a* controlled by the control unit 4.

FIGS. 4 to 8 are views showing an operating state of movable members of the latch mechanism 14, the operating mechanism 15, and the motor member 16. As shown in FIGS. 4 to 8, the latch 13 and a locking piece 17 to be engaged with the latch 13 are mounted on the latch mechanism 14.

A housing 14A (only shown in FIG. 3) of the latch mechanism 14 rotatably supports the latch 13 in a manner that a not-shown latch supporting shaft is inserted into a hole 13A formed on the latch 13. The latch 13 includes a U-shaped groove 13C opened on an outer peripheral wall 138. The striker 12 is guided into the U-shaped groove 130 when the lower door is moved manually. Further, first and second engaging projections 13D, 13E to be engaged with the locking piece 17 are projected from the outer peripheral wall 13B.

A latch lever 18 is fixed to the latch 13. The latch supporting shaft is also inserted into a hole 18A formed on the latch lever 18. An arm part 18B extending away from a rotation center of the latch 13 is formed on the latch lever 18. An engaging pin 18C is extended vertically from a tip of the arm part 18B.

The locking piece 17 is arranged parallel to the latch supporting shaft, and fixed to a locking piece supporting shaft 19 rotatably supported by the housing 14A. A locking piece lever 20 is fixed to a top end of the locking piece supporting shaft 19.

FIG. 5 is a plan view showing the latch 13 and the locking piece 17. A not-shown spring presses the latch 13 in a clockwise direction in FIG. 5. Also, another not-shown spring presses the locking piece 17 in the clockwise direction in FIG. 5.

When the first engaging projection 13D is engaged with the locking piece 17 (half-latch state shown in FIG. 5) while the striker 12 is disposed in the U-shaped groove 130, the lower door is half-closed.

When the second engaging projection 13E is engaged with the locking piece 17 (full-latch state) while the striker 12 is disposed in the U-shaped groove 13C, the lower door is fully closed.

Further, both in the half-latch and full-latch states, when the locking piece 17 is rotated in a counterclockwise direction to release the engagement between the locking piece 17 and the latch 13, the latch 13 is rotated by the spring and abuts on a not-shown stopper to be held in an open state. While the latch 13 is in the open state, the striker 12 can be guided into or removed from the U-shaped groove 13C by manually moving the lower door or the like. Incidentally, while the latch 13 is in the open state, the locking piece 17 abuts on a not-shown stopper to be disposed on a position where the locking piece 17 can be engaged with the latch 13.

The latch mechanism 14 includes the latch switch 21 (only shown in FIG. 3) which can detect a position of the latch 13. The latch switch 21 includes the half-latch switch 21*a*, for detecting the half-latch state, the full-latch switch 21*b* for detecting the full-latch state, and the courtesy switch 21*c* for switching on a not-shown courtesy lamp when the rear door is open.

FIG. 10 is an explanatory view showing on/off ranges of the half-latch switch 21*a*, the full-latch switch 21*b*, and the courtesy switch 21*c*.

Specifically, when the latch 13 is rotated from the open state to the closed state, the half-latch switch 21*a* is changed from the on state to the off state just before the latch 13 is in the half-latch state, and keeps the off state. When the latch 13 is rotated from the closed state to the open state, the half-latch switch 21*a* is changed from the off state to the on state just after the latch 13 is in the half-latch state and keeps the on state.

Further, when the latch 13 is rotated from the open state to the closed state, the full-latch switch 21*b* is changed from the off state to the on state just when the latch 13 is in the full-latch state, and keeps the on state. When the latch 13 is rotated from the closed state to the open state, the full-latch switch 21*b* is changed from the on state to the off state just when the latch 13 is not in the full-latch state and keeps the off state.

Further, when the latch 13 is rotated from the open state to the closed state, the courtesy switch 21*c* is changed from the on state to the off state just while the latch 13 is changed from the half-latch state to the full-latch state, and keeps the off state. When the latch 13 is rotated from the closed state to the open state, the courtesy switch 21*c* is changed from the off state to the on state just before the latch 13 is in the half-latch state and keeps the on state.

The control unit 4 judges a point when the half-latch switch 21*a* is changed from the on state to the off state as a point when the latch 13 is turned in the half-latch state, and judges a point when the full-latch switch 21*b* is changed from the off state to the on state as a point when the latch 13 is turned in the full-latch state. Further, the control unit 4 judges a point when the full-latch switch 21*b* is changed from the on state to the off state as the latch 13 is turned in the open state, and judges a point when the full-latch switch 21*b* is changed from the off state to the on state as a point when the latch 13 is turned in the full-latch state.

Incidentally, the full-latch switch 21*b* and the half-latch switch 21*a* outputs on/off signals only according to the state of the latch 13 and independent from whether the striker 12 is inserted into the U-shaped groove 13C of the latch 13 or not.

The motor member 16 includes an output pinion gear 23 connected to the motor 16*a* via a not-shown reduction gear mechanism. The control unit 4 controls the motor member 16 to rotate the output pinion gear 23 in both back and forth directions. Incidentally, in the motor member 16, output driving forces and output driving speeds of the output pinion gear 23 are the same in both back and force directions.

The operating mechanism 15 includes an operating gear 24 as an operating member engaged with and driven by the output pinion gear 23. A gear supporting shaft 25 disposed not parallel to the latch supporting shaft and the locking piece supporting shaft 19 rotatably supports the operating gear 24. A planar shape of the operating gear 24 is substantially a sector shape. Gear teeth 24A to be engaged with the output pinion gear 23 are formed on an arc part of the sector shaped operating gear 24. The gear teeth 24A and an operating pin 24B extended from an end wall on an outer circumference of the operating gear 24 are formed by swaging.

A closing lever 26 is rotatably disposed on the gear supporting shaft 25. Corresponding to a rotation of the operating gear 24 in the counterclockwise direction of FIG. 4, an abutted part 26A of the closing lever 26 abuts on the operating pin 24B to be rotated in the counterclockwise direction.

Further, corresponding to a rotation of the operating gear 24 in the counterclockwise direction of FIG. 4, a closing operating piece 26B is allowed to abut on the engaging pin 18C of the latch lever 18. While the closing lever 26 abuts on the engaging pin 18C, when the closing lever 26 rotates in the counterclockwise direction of FIG. 4, the latch 13 is rotated in a closing direction (a moving direction from the open state to the full-latch state).

Incidentally, a not-shown spring presses the closing lever 26 in the clockwise direction of FIG. 4. When the closing lever 26 does not abut on the operating pin 24B, the closing lever 26 abuts on a not-shown stopper to be held in a predetermined position.

An opening lever 28 rotatably supported by an opening lever supporting shaft 27 disposed parallel to the gear supporting shaft 25 is provided on the operating mechanism 15 at an opposite side of the operating gear 24 via the closing lever 26. Corresponding to the rotation of the operating gear 24 in the clockwise direction of FIG. 4, an abutted part 28A of the opening lever 28 abuts on the operating pin 24B to allow the opening lever 28 to be rotated in the clockwise direction.

An opening operating piece 28B to abut on the locking piece lever 20 is provided on the opening lever 28 at an opposite side of the abutted part 28A via the opening lever supporting shaft 27. Corresponding to the rotation of the opening lever 28 owing to the operating gear 24 in the clockwise direction of FIG. 4, the opening operating piece 28B is allowed to abut on the locking piece lever 20. While the opening operating piece 28B abuts on the locking piece lever 20, when the opening lever 28 further rotates in the clockwise direction of FIG. 4, the locking piece 17 is rotated in a direction of releasing an engagement with the latch 13 (counterclockwise direction of FIG. 4).

Incidentally, a spring 28C (only shown in FIG. 3) presses the opening lever 28 in the counterclockwise direction of FIG. 4. When the opening lever 28 does not abut on the operating pin 24B, the opening lever 28 abuts on a not-shown stopper to be held in a predetermined position.

In the door open/close device 11, the control unit 4 controls the motor member 16 in a manner to rotate the operating gear 24 in directions of fully closing the door and opening the fully closed door based on a neutral position of the operating gear 24 where the operating pin 24B does not interfere with both closing and opening levers 26, 28. Incidentally, a state where the operating gear 24 is biased to a rotating direction for operating the closing lever 26 (the counterclockwise direction of FIGS. 4, 6 to 8) based on the neutral position is referred to as a state that the operating gear 24 is biased to the door fully closed side, or a state that the operating gear 24 is in the door fully closed side. Further, a state where the operating gear 24 is biased to a rotating direction for operating the opening lever 28 (the clockwise direction of FIGS. 4, 6 to 8) based on the neutral position is referred to as a state that the operating gear 24 is biased to the fully closed door releasing side, or a state that the operating gear 24 is in the fully closed door releasing side.

Incidentally, when the operating gear 24 is positioned in the neutral position, a gap is formed between the operating pin 24B of the operating gear 24 and the abutted parts 26A, 28A of both closing and opening levers 26, 28. When the operating gear 24 is rotated in a specific angle, the operating pin 24B and the abutted parts 26A, 28A abut on each other.

Further, when the operating pin 24B does not interfere with the closing and opening levers 26, 28, both levers 26, 28 are held in a predetermined position not to interfere with the latch mechanism 14. Therefore, in this state, corresponding to a movement of the rear door in the closing direction owing to such as a manual operation, the striker 12 inserted into the U-shaped groove 13C is pressed to make the latch 13 in the half-latch or full-latch state.

According to this embodiment, the neutral switch 29 as a neutral position detecting sensor mounted on the operating mechanism 15 detects which side the operating gear 24 is biased to, the door fully closed side or the fully closed door releasing side. The neutral switch 29 includes a rotor 29B rotatably supported by a base part 29A (only shown in FIG. 3) fixed to a base side of the operating mechanism 15. An engaging part 29C to be engaged with a sensor pin 24E mounted on the operating gear 24 is formed on the rotor 29B. The neutral switch 29 detects using a change of a direction of the rotor 29B based on a rotation of the operating gear 24 when the sensor pin 24E is engaged with the engaging part 29C.

When the operating gear 24 is positioned at around the neutral position, the engaging part 290 is engaged with the sensor pin 24E (see FIGS. 3 and 7). When the operating gear 24 is biased to the door fully closed side relative to the neutral position, the rotor 29B is rotated to turn the engaging part 29C upward (see FIG. 6), and the neutral switch 29 outputs the off signal to the control unit 4 (neutral switch is in an off state as the first state) (see FIG. 9). Further, when the operating gear 24 is biased to the fully closed door releasing side relative to the neutral position, the rotor 29B is rotated to turn the engaging part 29C downward (see FIG. 7), and the neutral switch 29 does not output the off signal to the control unit 4 (neutral switch is in an on state as the second state) (see FIG. 9).

The control unit 4 judges the switching point between the on state and the off state of the neutral switch 29 as the point when the operating gear 24 is positioned in the neutral position. Namely, the neutral switch 29 can detect the neutral position owing to the switching between the on state and the off state of the neutral switch 29.

Further, the control unit 4 judges switching point when the neutral switch 29 is changed from the off state to the on state as the point when the operating gear 24 is changed from the fully closed door releasing side to the neutral position. Further, the control unit 4 judges switching point when the neutral switch 29 is changed from the on state to the off state as the point when the operating gear 24 is changed from the door fully closed side to the neutral position.

Incidentally, when the operating gear 24 is biased to the door fully closed side or the fully closed door releasing side, and the sensor pin 24E is released from the engaging part 29C, a direction of the rotor 29B is held in the releasing state, namely, held in a state where the sensor pin 24E and the engaging part 29C are allowed to be engaged with each other again.

Next, an operation of the door open/close system for a vehicle having above-described structure will be explained with reference to FIGS. 11 to 16. FIGS. 11 and 12 are state transition diagrams of the door open/close system or a vehicle according to the present invention. FIG. 13A and FIG. 13B are operation explanatory views showing main parts of a door open/close device when operating from a fully opened state in a closing direction. FIG. 14A and FIG. 14B are operation explanatory views showing the main parts of the door open/close device when operating from a fully closed state in an opening direction. FIG. 15 is a signal timing chart showing main parts of the door open/close device when operating from the fully opened state in the closing direction. FIG. 16 is a signal timing chart showing the main part of the door open/close device when operating from the fully closed state in the opening direction.

Firstly, an operation of changing the lower door 3 from the fully opened state to the fully closed state will be explained with reference to the state transition diagram of FIG. 11. When the lower door 3 of the rear door is in the fully opened state, the door open/close device 11 (11') is halted, and the latch 13 (13') is in the open state and the operating gear 24 (24') is in substantially a neutral state (step S1 in FIG. 11) (timing block A of FIG. 15).

Under this state, the half latch switch 21*a* (21*a'*) of the latch switch 21 (21') is in the on state, the full-latch switch 21*b* (21*b'*) is in the off state, and the courtesy switch 21*c* (21*c'*) is in the on state. Further, the operating gear 24 (24') is a little biased to the door fully closed side relative to the neutral position, and the neutral switch 29 is in the off state.

Under this state, a user manually moves the lower door 3 in the closing direction, and the striker 12 (12') inserted into the U-shaped groove 13C (13C') rotates the latch 13 (13') in the closing direction. Then, the first engaging projection 13D (13D') is engaged with the locking piece 17 (17') to turn the latch 13 (13') in the half-latch state shown in FIG. 5.

At this time, when both the half-latch switch 21*a* of the door open/close device 11 and the half-latch switch 21*a'* of the door open/close device 11' are changed from the on state to the off state, the judging part 5*a* judges that latches of all the door open/close devices are in the half-latch state (step S2), and a process goes to step S3. Namely, in step S2, detecting half-latch positions of all the door open/close devices is defined as a condition 1. When the condition 1 is satisfied, the process goes to the next step.

When the condition 1 is satisfied, the control part 5*b* of the control unit 4 turns the door open/close devices 11, 11' in a standby state for synchronous fully closed state, and waits for a specific time (for example, 0.3 sec) (step S3) (timing block B in FIG. 15). When the latch of any one of the door open/close devices is out of the half-latch state by some reason during waiting, for example, the lower door 3 moves back in the fully opening direction, the condition 1 is not satisfied, and the fully closing operation is stopped (condition 2) (step S4).

Next, when the judging part 5*a* judges that the waiting time is over (condition 2) (step S5), the control part 5*b* turns the door open/dose devices 11, 11' in a synchronous fully closed state (step S6) (timing block C in FIG. 15). Namely, the control part 5*b* starts driving synchronously the motors 16*a*. 16*a'* of the door open/close devices 11, 11' in a normal rotation.

Thus, as shown in FIGS. 13A and 13B, the operating gear 24 (24) is rotated in the counterclockwise direction, and when a rotational angle thereof reaches a specific angle, the operating pin 24B (24B') abuts on the abutted part 26A (26A') of the closing lever 26 (26') to rotate the closing lever 26 (26').

The closing lever 26 (26') is further rotated after the closing lever 26 (26') reaches the specific rotation angle, while the closing operating piece 26B (26B) abuts on the engaging pin 18C (18C'), the latch 13 (13') is rotated toward the full-latch state side. When the closing operating piece 26B (26B') is rotated to a position indicated by a dotted line of FIG. 13B, the engaging pin 18C (18C') is rotated to the position indicated by the dotted line (see FIG. 6). Resultingly, owing to the rotation of the latch 13 (13'), the striker 12 (12') is drawn so that the lower door 3 is in the fully closed state (not shown in FIG. 6). Incidentally, the courtesy switch 21*c*(21*c'*) is changed from the on state to the off state while the latch 13 (13') is rotated.

When the latch 13 (13') is over the full-latch state where the lower door 3 is held in the fully closed state, the full-latch switch 21*b* (21*b'*) is changed from the off state to the on state. Incidentally, because the motor 16*a* (16*a'*) of the motor member 16 (16') drives to rotate the latch 13 (13') until the full-latch switch 21*b* (21*b'*) is turned in the on state, the second engaging projection 13E (13E') is surely engaged with the locking piece 17 (17'). When the judging part 5*a* judges that the full-latch switch 21*b* (21*b'*) is turned in the on state, the control part 5*b* controls to stop the motor 16*a* (16*a'*). Namely, the control part 5*b* stops the motor member 16 and the motor member 16' asynchronously.

At this time, when both the full-latch switch 21*b* of the door open/close device 11 and the full-latch switch 21*b'* of the door open/close device 11' are changed from the off state to the on state, the judging part 5*a* of the control unit 4 judges that the latches 13 of all the door open/close devices are turned in the full-latch state, and judges that all the closing operations are finished (condition 4) (step S7), and the process goes to the next step.

Next, the control part 5*b* of the control unit 4 turns the door open/close devices 11, 11' in a standby state for a return to fully closed state, and waits for a specific time (for example, 0.3 sec) (step S8) (timing block D in FIG. 15).

Next, when the judging part 5*a* judges that standby for return to fully closed state is over (condition 5) (step S9), the control part 5*b* turns the door open/close devices 11, 11' in a return to synchronous fully closing operation state (return to the neutral position operation state) (step S10) (timing block E in FIG. 15). Namely, the control part 5*b* synchronously starts driving the motors 16*a*. 176*a'* of the door open/close devices 11, 11' in a reverse rotation. Thus, the second engaging projection 13E (13E') is surely engaged with the locking piece 17 (17'), and the latch 13 (13') is turned in the full-latch state. Further, an engagement between the closing operating piece 26B (26B') and the engaging pin. 18C (18C') is released to reduce a stress excessively applied to the latch mechanism 14 (14') and the operating mechanism 15 (15') (see FIG. 7).

Owing to the reversely driving of the motor 16*a* (16*a'*), the operating gear 24 (24') starts rotating in the clockwise direction. When the operating gear 24 (24') is rotated to the neutral position, the neutral switch 29 (29') is changed from the off state to the on state, and this changing is informed to the judging part 5*a*.

The judging part 5*a* judges this changing as an end of return to the neutral position (condition 6) in which the operating gear 24 (24') reaches the neutral position. Corresponding to this judgment, the control part 5*b* controls to stop the motor 16*a* (16*a'*) (step S10). At this time, the operating gear 24 (24') stops at a position a little over the neutral position owing to a time lag of the control of the control part 5*b* and mechanical inertia of the motor member 16 (16') and the operating gear 24 (24'). Under this state, the operating gear 24 (24') is a little biased to the fully closed door releasing side relative to the neutral position. In the position a little over the neutral position, even when the operating pin 24B (24B') abuts on the abutted part 28A (28A') of the opening lever 28 (28'), the locking piece 17 (17') is not opened because the opening operating piece 28B (28B') does not interfere with the locking piece lever 20 (20').

This state is the fully closed state where the lower door 3 is fully closed, and the door open/close device 11 (11') is halted. (step S1) (timing block F in FIG. 15).

Thus, after the lower door 3 is manually moved in the fully closing direction until all the door open/close devices are in the half-latch state, the lower door 3 is automatically moved from the half-latch state to the full-latch state to be in the fully closed state owing to the driving of the motor 16*a* (16*a'*). Therefore, the open/close of the lower door 3 is easily and surely controlled.

Incidentally, when the lower door 3 is manually not moved in the fully closing direction till all the door open/close devices are in the half-latch state, for example, when one door open/close device 11 is in the half-latch state, but the other door open/close device 11' is not in the half-latch state, the lower door 3 is never automatically fully closed. Therefore, when the lower door 3 is changed from the fully opened state to the fully closed state, for making the latch 13 and the latch 13' of the door open/close device 11 and the door open/close device 11' in the half-latch state, user's pushing operations to the door open/close devices 11, 11' are needed. Therefore, user's burden is large. Further, if the pushing operations are not completed, the lower door 3 may be in a half shut position.

Accordingly, in this embodiment, when the half-latch position of any one of the door open/close devices is detected, the:motor of the one door open/close device starts driving to move the lower door 3 in the fully closing direction. Thus, the rest of the door open/close devices are moved to the half-latch positions. Resultingly, the motors of all the door open/close devices are allowed to drive so that the lower door 3 is allowed to be changed in the fully closed state. Namely, according to this embodiment, when the lower door 3 is changed from the fully opened state to the fully closed state, the door open/close devices not in the half-latch positions are assisted to be moved to the half-latch positions.

Specifically, this assist operation is done by steps 513 to 517 in a flowchart of FIG. 11.

Namely, the user manually moves the lower door 3 in the closing direction, the half-latch switch 21*a* of any one of the door open/close devices 11, 11', for example, of the door open/close device 11 is changed from the on state to the off state, and the judging part 5*a* judges that any one of the door open/close devices is changed to be in the half-latch position (condition 7) (step S13). Then, the control part 5*b* changes the door open/close device 11 to the standby state for fully closed state and waits for a specific time (for example, 0.3 sec) (step S3). While the door open/close device 11 is in a standby mode, when the latch 13 of the door open/close device 11 is out of the half-latch state caused by some reason, for example, the lower door 3 moves back in the fully opening direction, the fully closing operation is stopped (condition 2) (step S4) because the condition 7 is not satisfied.

Next, the control part 5*b* changes the door open/close device 11 to the standby state for fully closed state, and waits for a specific time (for example, 0.3 sec) (step S3). Next, the control part 5*b* starts the assist operation (condition 8) (step S14). Next, the control part 5*b* changes the door open/close device 11 to the fully closed state (step S6). Namely, the control part 5*b* starts driving the motor 16*a* in the normal rotation. Therefore, the lower door 3 is further moved in the fully closing direction from the half latch position of the door open/close device 11.

As the result of this movement, the half-latch switches 21*a'* of the door open/close devices not in the half-latch positions are changed from the on state to the off state, and all the door open/close devices are in the half-latch positions to satisfy the condition 1 of the step S2. Then, as described above, the process goes from step S3 to 811, and the lower door 3 is changed to the fully closed state (step S12).

On the other hand, in a case that the assist operation is done in step S14, and the lower door 3 is fully closed state in step S6, when the motor 16*a'* of the door open/close device 11' does not start driving while the latch 13 of the door open/close device 11 is changed from the half-latch state to the full-latch state, the judging part 5*a* judges that the assist operation is failed or stopped (step S7). Then, the control part 5*b* changes the lower door 3 in the standby state for a return to fully closed state (step S8), and requests the assist failure reverse operation (condition 9) (step S15).

Next, the control part 5*b* changes all the activated door open/close devices, namely, the door open/close device 11 to a release of the fully closed state (step S16). Namely, the control part 5*b* drives the motor 16*a* of the door open/close device 11 in the reverse rotation.

Accordingly, the lower door 3 is moved in the fully opening direction. When the half-latch switch 21*a* of the door open/close device 11 is changed from the off state to the on state, the judging part 5*a* judges that the door open/close device 11 is in the state before the start of driving, and a release of fully closed state is finished (condition 10) (step S17). Then, the process goes to step S10 to S 11 and returns to the halt state (step S1).

Next, an operation to change the lower door 3 of the rear door from the fully closed state to the fully opened state will be explained. When the lower door 3 of the rear door is in the fully closed state, the door open/close device 11 (11') is in the halt state, the latch 13 (13') is in the closed state and the operating gear 24 (24') is in substantially a neutral state (step S21 in FIG. 12) (timing block H of FIG. 16).

Under this state, the half-latch switch 21*a* (21*a'*) of the latch switch 21 (21') is in the off state, the full-latch switch 21*b* (21*b'*) is in the off state, and the courtesy switch 21*c* (21*c'*) is in the off state. Further, the operating gear 24 (24') is a little biased to the door fully opened side relative to the neutral position, and the neutral switch 29 is in the on state.

Under this state, a user operates the handle switch button 30*a* for manually fully open the lower door 3 (the opened state), and the handle switch 30 is changed from the off state to the on state (condition 11 in step S22). Then, the control part 5*b* instructs motor driving circuits 9, 10 to start driving synchronously the motors 16*a*. 16*a'* for releasing the fully closed states of the door open/close devices 11, 11' and turns the door open/close devices 11, 11' in synchronous fully opened states (step S23) (timing block T in FIG. 16). Namely, the control part 5*b* synchronously starts driving the motors 16*a*. 16*a'* of the door open/close devices 11, 11' in the reverse rotation.

Thus, as shown in FIGS. 14A and 14B, the operating gear 24 (24') starts rotating in the clockwise direction and when the rotation angle thereof reaches a specific angle, the operating pin 24B (24B') abuts on the abutted part 28A (28A') of the opening lever 28 (28') to rotate the opening lever 28 (28').

The opening lever 28 (28') is further rotated after the opening lever 28 (28') reaches the specific rotation angle, while the opening operating piece 28B (28B') abuts on the locking piece lever 20 (20'), the locking piece 17 (17') is rotated in a direction of releasing the engagement with the latch 13 (13'). When the opening operating piece 28B (28B') is rotated to a position indicated by a dotted line of FIG. 15B, the locking piece lever 20 (20') is rotated to the position indicated by the dotted line (see FIG. 8). Resultingly, the engagement between the locking piece 17 (17') and the latch 13 (13') is released, and the latch 13 (13') is rotated to the open state side owing to urging force of the spring. Resultingly, the striker 12 (12') is allowed to be pulled out of the U-shaped groove 13C (13C'), and the lower door 3 is allowed to be released from the fully closed state.

Thus, when the latch 13 (13') is rotated from the full-latch state to the opened state, in the middle of the rotation, firstly, the full-latch switch 21*b* (21*b'*) is changed from the off state to the on state. Then, the courtesy switch 21*c* (21*c'*) is changed from the off state to the on state. Lastly, the half-latch switch 21*a* (21*a'*) is changed from the off state to the on state. When the judging part 5*a* detects the on state of the courtesy switch 21*c* (21*c'*), the control part 5*b* controls to stop the motor 16*a* (16*a'*). Namely, the control part 5*b* stops the motor member 16 and the motor member 16' asynchronously.

At this time, when both the courtesy switch 21*c* of the door open/close device 11 and the courtesy switch 21*c'* of the door open/close device 11' are changed from the off state to the on state, the judging part 5*a* of the control unit 4 judges that the latches 13 of all the door open/close devices are turned in the open state, and judges that the lower door 3 is allowed to be manually opened and all the opening operations are finished (condition 12) (step S24), and the process goes to the next step.

Next, the control part 5*b* of the control unit 4 turns the door open/close devices 11, 11' in a standby state for a return to fully opened state, and waits for a specific time (for example, 0.3 sec) (step S25) (timing block J in FIG. 16).

Next, when the judging part 5*a* judges that standby for return to fully opened state is over (condition 13) (step S26), the control part 5*b* turns the door open/close devices 11, 11' in a return to synchronous fully opening operation state (return to the neutral position operation state) (step S27) (timing block K in FIG. 16). Namely, the control part 5*b* synchronously starts driving the motors 16*a*. 176*a'* of the door open/close devices 11, 11' in a normal rotation.

Owing to the normal driving of the motor 16*a* (16*a'*), the operating gear 24 (24') starts rotating in the counterclockwise direction. When the operating gear 24 (24') is rotated to the neutral position, the neutral switch 29 (29') is changed from the on state to the off state, and this changing is informed to the judging part 5*a*.

The judging part 5*a* judges this changing as an end of return to the neutral position (condition 14) (step S28) in which the operating gear 24 (24') reaches the neutral position. Corresponding to this judgment, the control part 5*b* controls to stop the motor 16*a* (16*a'*). At this time, the operating gear 24 (24') stops at a position a little over the neutral position owing to a time lag of the control of the control part 5*b* and mechanical inertia of the motor member 16 (16') and the operating gear 24 (24'). Under this state, the operating gear 24 (24') is a little biased to the fully closed door side relative to the neutral position. In the position a little over the neutral position, even when the operating pin 24B (24B') abuts on the abutted part 26A (26A') of the opening lever 26 (26'), the latch 13 is not opened because the closing operating piece 26B (26B') does not interfere with the locking engaging pin 18C (18C').

This state is the fully opened state to allow the lower door 3 to be manually opened after all the operations toward the fully opened state are finished and in the halt state, and the process returns to step S21 (timing block L in FIG. 16).

As above described, according to the door open/close system for a vehicle of the present invention, because the door of the vehicle is easily and surely opened or closed with a plurality of motors, the burden of labor for a user is decreased, and a half-shut door is prevented. Further, a smooth synchronous control in consideration of user's safety is done, and the vehicle door can be surely fully closed. Further, as the number of the door open/close devices increases, user's burden of labor decreases. Further, because the conventional door open/close device can be used without changing as the synchronously controlled device, cost of the door open/close system for a vehicle decreases.

Next, an operation of the door open/close system for a vehicle having above-described structure according to the second embodiment of the present invention will be explained with reference to FIGS. 13 to 15 and FIG. 19. FIG. 19 is a state transition diagram of the door open/close system for a vehicle according to the present invention. FIG. 13A and FIG. 13B are operation explanatory views showing main parts of a door open/close device when operating from a fully opened state in a closing direction. FIG. 14A and FIG. 14B are operation explanatory views showing the main parts of the door open/close device when operating from a fully closed state in an opening direction. FIG. 15 is a signal timing chart showing main parts of the door open/close device when operating from the fully opened state in the closing direction. FIG. 16 is a signal timing chart showing the main part of the door open/close device when operating from the fully closed state in the opening direction.

Firstly, an operation of changing the lower door 3 from the fully opened state to the fully closed state will be explained. When the lower door 3 of the rear door is in the fully opened state (step S101 in FIG. 18) (timing block A of FIG. 15), the latch 13 (13') is in the open state and the operating gear 24 (24') is in substantially a neutral state.

Under this state, the half-latch switch 21*a* (21*a'*) of the latch switch 21 (21') is in the on state, the full-latch switch 21*b* (21*b'*) is in the off state, and the courtesy switch 21*c* (21*c'*) is in the on state. Further, the operating gear 24 (24') is a little biased to the door fully closed side relative to the neutral position, and the neutral switch 29 is in the off state.

Under this state, a user manually moves the lower door 3 in the closing direction, and the striker 12 (12') inserted into the U-shaped groove 13C (13C') rotates the latch 13 (13') in the closing direction. Then, the first engaging projection 13D (13D') is engaged with the locking piece 17 (17') to turn the latch 13 (13') in the half-latch state shown in FIG. 5.

At this time, when both the half-latch switch 21*a* of the door open/close device 11 and the half-latch switch 21*a'* of the door open/close device 11' are changed from the on state to the off state, the judging part 5*a* judges that latches of all the door open/close devices are in the half-latch state (step S102), and a process goes to step S103. Namely, in step S102, detecting half-latch positions of all the door open/close devices is defined as a condition 101. When the condition 101 is satisfied, the process goes to the next step. Therefore, even if the half-latch position of only one of two door open/close devices 11, 11' is detected, the process does not go to next step. When the half-latch positions of two door open/close devices 11, 11' are detected, the process goes to the next step.

When the condition 101 is satisfied, the control part 5*b* of the control unit 4 turns the door open/close devices 11, 11' in a standby state for synchronous fully closed state, and waits for a specific time (for example, 0.3 sec) (step S103) (timing block B in FIG. 15).

Next, when the judging part 5*a* judges that the waiting time is over (condition 102) (step S104), the control part 5*b* turns the door open/close devices 11, 11' in a synchronous fully closed state (step S105) (timing block C in FIG. 15). Namely, the control part 5*b* starts driving synchronously the motors 16*a*. 16*a'* of the door open/close devices 11, 11' in a normal rotation.

Thus, as shown in FIGS. 13A and 13B, the operating gear 24 (24') is rotated in the counterclockwise direction, and when a rotational angle thereof reaches a specific angle, the operating pin 24B (24B') abuts on the abutted part 26A (26A') of the closing lever 26 (26') to rotate the closing lever 26 (26').

The closing lever 26 (26') is further rotated after the closing lever 26 (26') reaches the specific rotation angle, while the closing operating piece 26B (26B') abuts on the engaging pin 18C (18C'), the latch 13 (13') is rotated toward the full-latch state side. When the closing operating piece 26B (26B') is rotated to a position indicated by a dotted line of FIG. 12B, the engaging pin 18C (18C') is rotated to the position indicated by the dotted line (see FIG. 6). Resultingly, owing to the rotation of the latch 13 (13'), the striker 12 (12') is drawn so that the lower door 3 is in the fully closed state (not shown in FIG. 6). Incidentally, the courtesy switch 21*c* (21*c'*) is changed from the on state to the off state while the latch 13 (13') is rotated.

When the latch 13 (13') is over the full-latch state where the lower door 3 is held in the fully closed state, the full-latch switch 21*b* (21*b'*) is changed from the off state to the on state. Incidentally, because the motor 16*a* (16*a'*) of the motor member 16 (16') drives to rotate the latch 13 (13') until the full-latch switch 21*b* (21*b'*) is turned in the on state, the second engaging projection 13E (13E') is surely engaged with the locking piece 17 (17'). When the judging part 5*a* judges that the full-latch switch 21*b* (21*b'*) is turned in the on state, the control part 5*b* controls to stop the motor 16*a* (16*a'*). Namely, the control part 5*b* stops the motor member 16 and the motor member 16' asynchronously.

At this time, when both the full-latch switch 21*b* of the door open/close device 11 and the full-latch switch 21*b'* of the door open/close device 11' are changed from the off state to the on state, the judging part 5*a* of the control unit 4 judges that the latches 13 of all the door open/close devices are turned in the full-latch state, and judges that all the closing operations are finished (condition 103) (step S106), and the process goes to the next step.

Next, the control part 5*b* of the control unit 4 turns the door open/close devices 11, 11' in a standby state for a return to fully closed state, and waits for a specific time (for example, 0.3 sec) (step S107) (timing block D in FIG. 15).

Next, when the judging part 5*a* judges that the return to fully closed state waiting time is over (condition 104) (step S108), the control part 5*b* turns the door open/close devices 11, 11' in a return to synchronous fully closing operation state (return to the neutral position operation state) (step S109) (timing block E in FIG. 15). Namely, the control part 5*b* synchronously starts driving the motors 16*a*. 176*a'* of the door open/close devices 11, 11' in a reverse rotation. Thus, the second engaging projection 13E (13E') is surely engaged with the locking piece 17 (17'), and the latch 13 (13') is turned in the full-latch state. Further, an engagement between the closing operating piece 26B (26B') and the engaging pin 18C (18C') is released to reduce a stress excessively applied to the latch mechanism 14 (14') and the operating mechanism 15 (15') (see FIG. 7).

Owing to the reversely driving of the motor 16*a* (16*a'*), the operating gear 24 (24') starts rotating in the clockwise direction. When the operating gear 24 (24') is rotated to the neutral position, the neutral switch 29 (29') is changed from the off state to the on state, and this changing is informed to the judging part 5*a*.

The judging part 5*a* judges this changing as an end of return to the neutral position (condition 105) in which the operating gear 24 (24') reaches the neutral position. Corresponding to this judgment, the control part 5*b* controls to stop the motor 16*a* (16*a'*) (step S110). At this time, the operating gear 24 (24') stops at a position a little over the neutral position owing to a time lag of the control of the control part 5*b* and mechanical inertia of the motor member 16 (16') and the operating gear 24 (24'). Under this state, the operating gear 24 (24') is a little biased to the fully closed door releasing side relative to the neutral position. In the position a little over the neutral position, even when the operating pin 24B (24B') abuts on the abutted part 28A (28A') of the opening lever 28 (28'), the locking piece 17 (17') is not opened because the opening operating piece 28B (28B') does not interfere with the locking piece lever 20 (20').

This state is the fully closed state where the lower door 3 is fully closed (step S111) (timing block F in FIG. 15).

Next, an operation to change the lower door 3 of the rear door from the fully closed state to the fully opened state will be explained. When the lower door 3 of the rear door is in the fully closed state (step S111 in FIG. 19) (timing block H of FIG. 16), the latch 13 (13') is in the closed state and the operating gear 24 (24') is in substantially a neutral state.

Under this state, the half-latch switch 21*a* (21*a'*) of the latch switch 21 (21') is in the off state, the full-latch switch 21*b* (21*b'*) is in the off state, and the courtesy switch 21*c* (21*c'*) is in the off state. Further, the operating gear 24 (24') is a little biased to the door fully opened side relative to the neutral position, and the neutral switch 29 is in the on state.

Under this state, a user operates the handle switch button 30*a* for manually fully open the lower door 3 (the opened state), and the handle switch 30 is changed from the off state to the on state (condition 106 in step S112). Then, the control part 5*b* instructs motor driving circuits 9, 10 to start driving synchronously the motors 16*a*. 16*a'* for releasing the fully closed states of the door open/close devices 11, 11' and turns the door open/close devices 11, 11' in synchronous fully opened states (step S113) (timing block T in FIG. 16). Namely, the control part 5*b* synchronously starts driving the motors 16*a*. 16*a'* of the door open/close devices 11, 11' in the reverse rotation.

Thus, as shown in FIGS. 13A and 13B, the operating gear 24 (24') starts rotating in the clockwise direction and when the rotation angle thereof reaches a specific angle, the operating pin 24B (24B') abuts on the abutted part 28A (28A') of the opening lever 28 (28') to rotate the opening lever 28 (28').

The opening lever 28 (28') is further rotated after the opening lever 28 (28') reaches the specific rotation angle, while the opening operating piece 28B (28B') abuts on the locking piece lever 20 (20'), the locking piece 17 (17') is rotated in a direction of releasing the engagement with the latch 13 (13'). When the opening operating piece 28B (28B') is rotated to a position indicated by a dotted line of FIG. 13B, the locking piece lever 20 (20') is rotated to the position indicated by the dotted line (see FIG. 8). Resultingly, the engagement between the locking piece 17 (17') and the latch 13 (13') is released, and the latch 13 (13') is rotated to the open state side owing to urging force of the spring. Resultingly, the striker 12 (12') is allowed to be pulled out of the U-shaped groove 13C (13C'), and the lower door 3 is allowed to be released from the fully closed state.

Thus, when the latch 13 (13') is rotated from the full-latch state to the opened state, in the middle of the rotation, firstly, the full-latch switch 21*b* (21*b'*) is changed from the off state to the on state. Then, the courtesy switch 21*c* (21*c'*) is changed from the off state to the on state. Lastly, the half-latch switch 21*a* (21*a'*) is changed from the off state to the on state. When the judging part 5*a* detects the on state of the courtesy switch 21*c* (21*c'*), the control part 5*b* controls to stop the motor 16*a* (16*a'*). Namely, the control part 5*b* stops the motor member 16 and the motor member 16' asynchronously.

At this time, when both the courtesy switch 21*c* of the door open/close device 11 and the courtesy switch 21*c'* of the door open/close device 11' are changed from the off state to the on state, the judging part 5*a* of the control unit 4 judges that the latches 13 of all the door open/close devices are turned in the open state, and judges that the lower door 3 is allowed to be manually opened and all the opening operations are finished (condition 107) (step S114), and the process goes to the next step.

Next, the control part 5*b* of the control unit 4 turns the door open/close devices 11, 11' in a standby state for a return to fully opened state, and waits for a specific time (for example, 0.3 sec) (step S115) (timing block J in FIG. 16). Next, when the judging part 5*a* judges that the return to fully opened state waiting time is over (condition 108) (step S116), the control part 5*b* turns the door open/close devices 11, 11' in a return to synchronous fully opening operation state (return to the neutral position operation state) (step S117) (timing block K in FIG. 16). Namely, the control part 5*b* synchronously starts driving the motors 16*a*. 176*a'* of the door open/close devices 11, 11' in a normal rotation.

Owing to the normal driving of the motor 16*a* (16*a'*), the operating gear 24 (24') starts rotating in the counterclockwise direction. When the operating gear 24 (24') is rotated to the neutral position, the neutral switch 29 (29') is changed from the on state to the off state, and this changing is informed to the judging part 5*a*.

The judging part 5*a* judges this changing as an end of return to the neutral position (condition 109) in which the operating gear 24 (24') reaches the neutral position. Corresponding to this judgment, the control part 5*b* controls to stop the motor 16*a* (16*a'*) (step S118). At this time, the operating gear 24 (24') stops at a position a little over the neutral position owing to a time lag of the control of the control part 5*b* and mechanical inertia of the motor member 16 (16') and the operating gear 24 (24'). Under this state, the operating gear 24 (24') is a little biased to the fully closed door side relative to the neutral position. In the position a little over the neutral position, even when the operating pin 24B (24B) abuts on the abutted part 26A (26A') of the opening lever 26 (26'), the latch 13 is not opened because the closing operating piece 26B (26B') does not interfere with the locking engaging pin 18C (18C').

This state is the fully opened state to allow the lower door 3 to be manually opened after all the operations toward the fully opened state are finished, and the process returns to step S101 (timing block L in FIG. 16).

As above described, according to the door open/close system for a vehicle of the present invention, because the door of the vehicle is easily and surely opened or closed with a plurality of motors, the burden of labor for a user is decreased, and a half-shut door is prevented. Further, because the door does not start fully closing until all the door open/close devices are in the half-latch state when the door is changed from the fully open state to the fully closed state, catching a user with the door, which is one of reasons to be a half-shut door, is prevented and a safety of a human body is secured. Further a trouble or a deformation of a vehicle caused by catching something with the door is prevented. Further, because a plurality of motors is synchronously driven, the smooth feeling like a single motor is realized, and the sense of incompatibility is not experienced. Therefore, a high-quality door open/close system for a vehicle can be realized. Further, because a plurality of motors is surely synchronously driven, a drift of motor sound in a long time is prevented, and the door open/close system works with a smaller noise. Therefore, the high-quality door open/close system for a vehicle can be provided.

The embodiments of the present invention has been explained as described above, however, the present invention is not limited to this, and various modifications and applications are possible.

For example, according to the embodiments described above, the striker is disposed at the vehicle body, and the door open/close device is disposed at the vehicle door. Instead of this, the striker may be disposed at the vehicle door, and the door open/close device may be disposed at the vehicle body.

Further, according to the embodiments described above, the process waits for a specific time in a standby state, however, the process may wait for no time.

Further, according to the embodiments described above, the door open/close system is used for the lower door of the rear door composed of the upper flip-up rear door and the lower flip-down rear door. However, the present invention is not limited to this. The door open/close system for a vehicle can be used for any vehicle door as long as the door is open/closed using a plurality of motors.

EXPLANATIONS OF LETTERS OR NUMERALS

Figure 1:
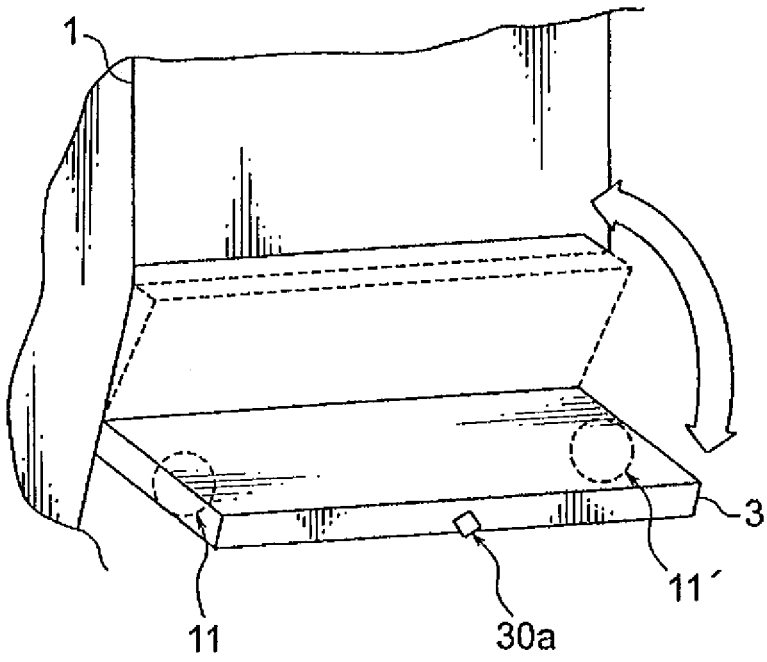
[FIG. 1] a view showing a main part of a vehicle in which a door open/close system for a vehicle according to the present invention is used.
Figure 2:
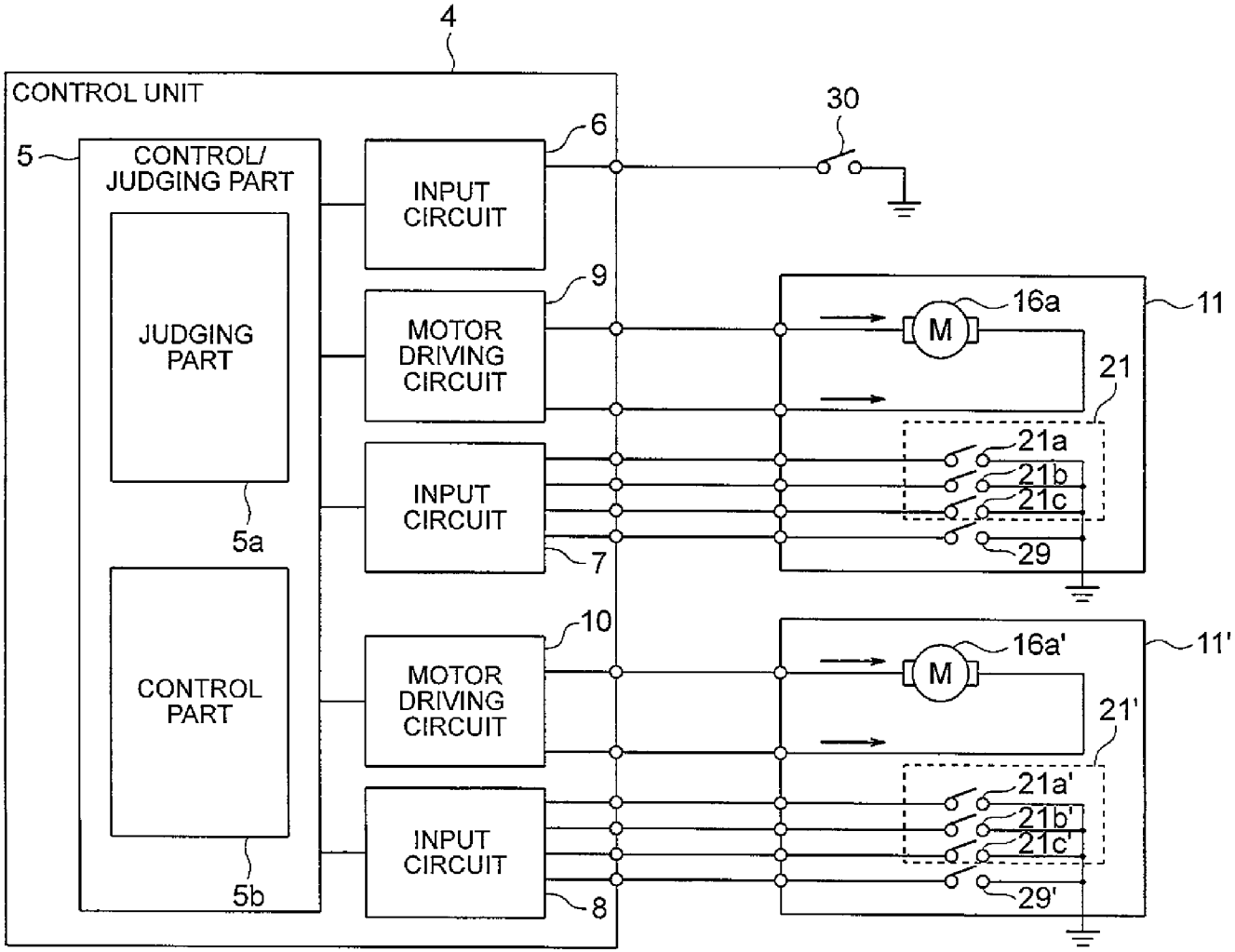
[FIG. 2] a block diagram showing an electrical structure of the door open/close system for a vehicle according to the present invention.
Figure 3:
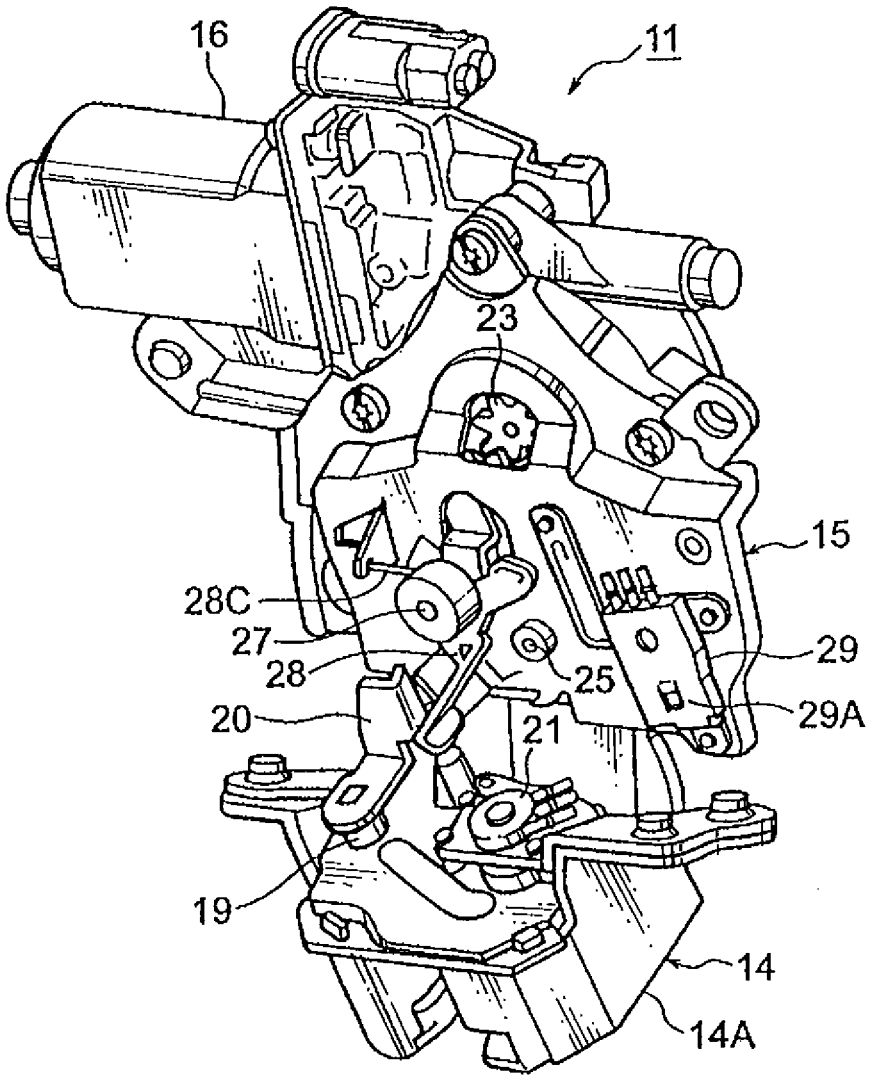
[FIG. 3] a perspective view showing a mechanical outline of a door open/close system composing the door open/close system for a vehicle according to the present invention.
Figure 4:
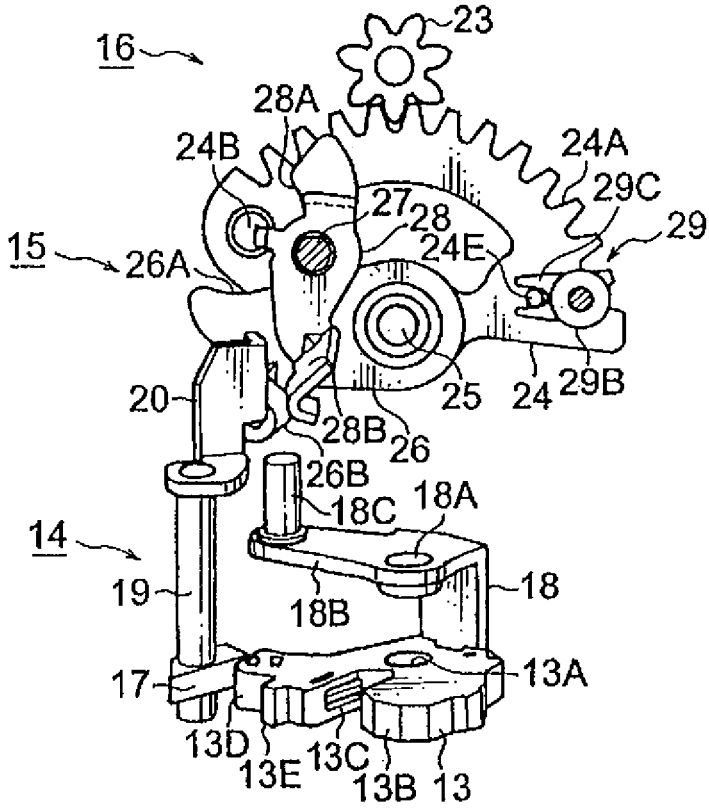
[FIG. 4] an explanatory view showing a main part of the door open/close device in a substantially neutral position.
Figure 5:
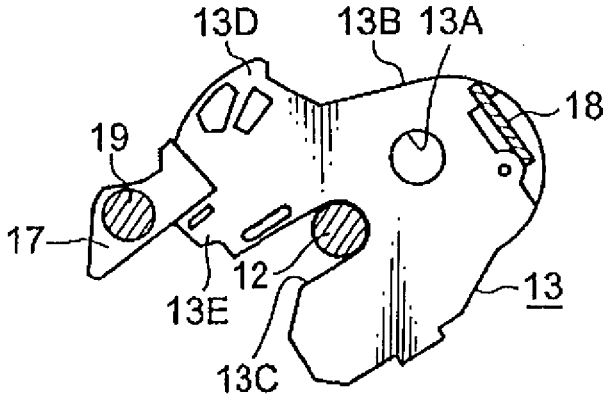
[FIG. 5] a plane view showing a main part of a latch mechanism of the door open/close device.
Figure 6:
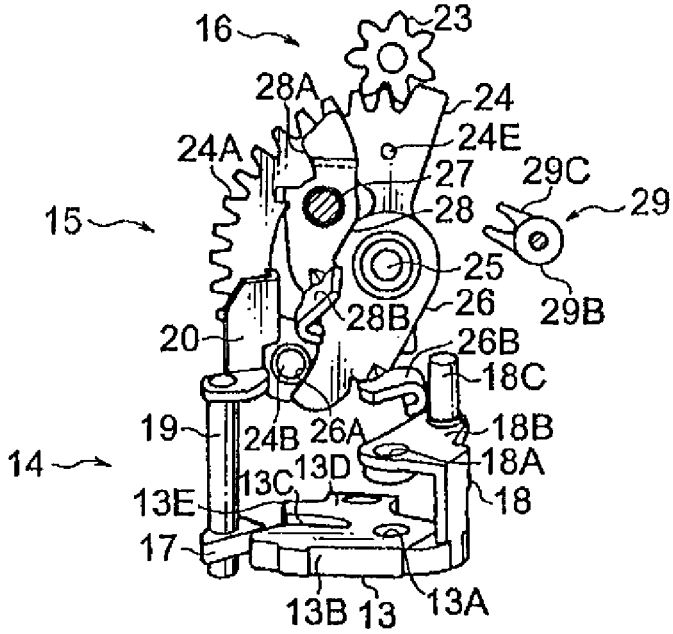
[FIG. 6] an explanatory view showing the main part of the door open/close system.
Figure 7:
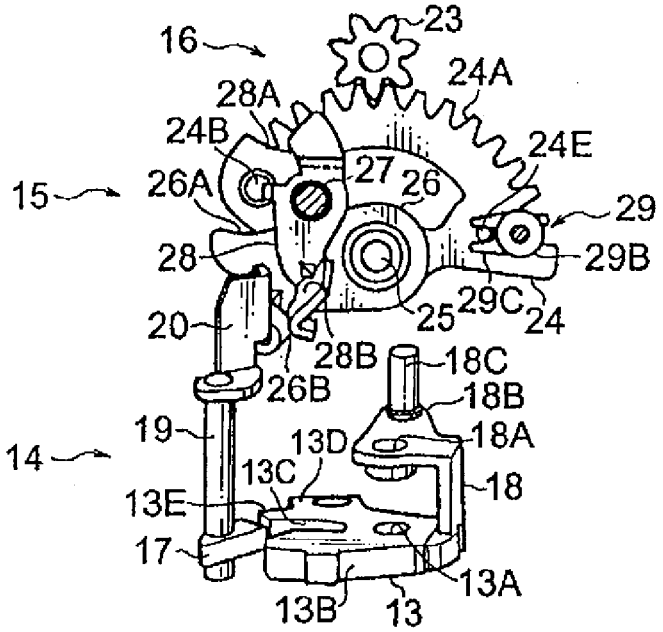
[FIG. 7] an explanatory view showing the main part of the door open/close system.
Figure 8:
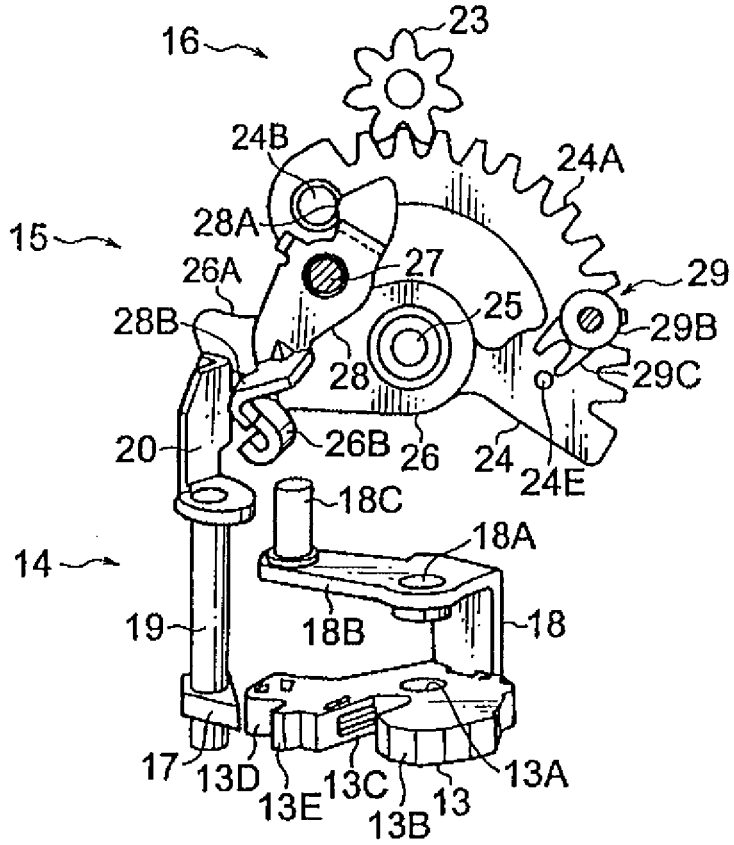
[FIG. 8] an explanatory view showing the main part of the door open/close system.
Figure 9:
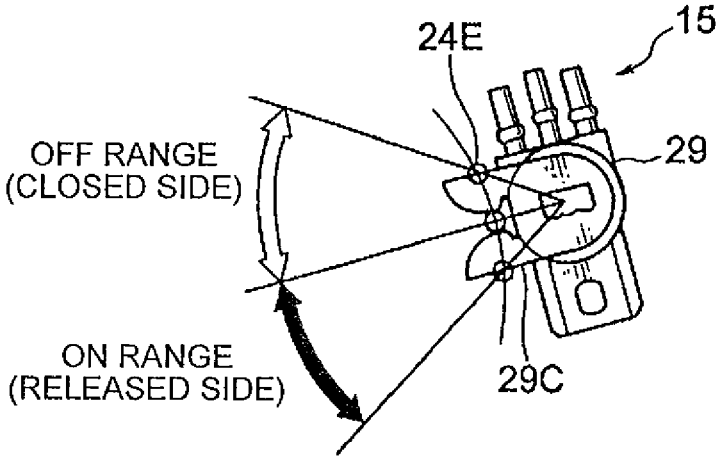
[FIG. 9] an explanatory view showing a neutral switch of the door open/close system.
Figure 10:
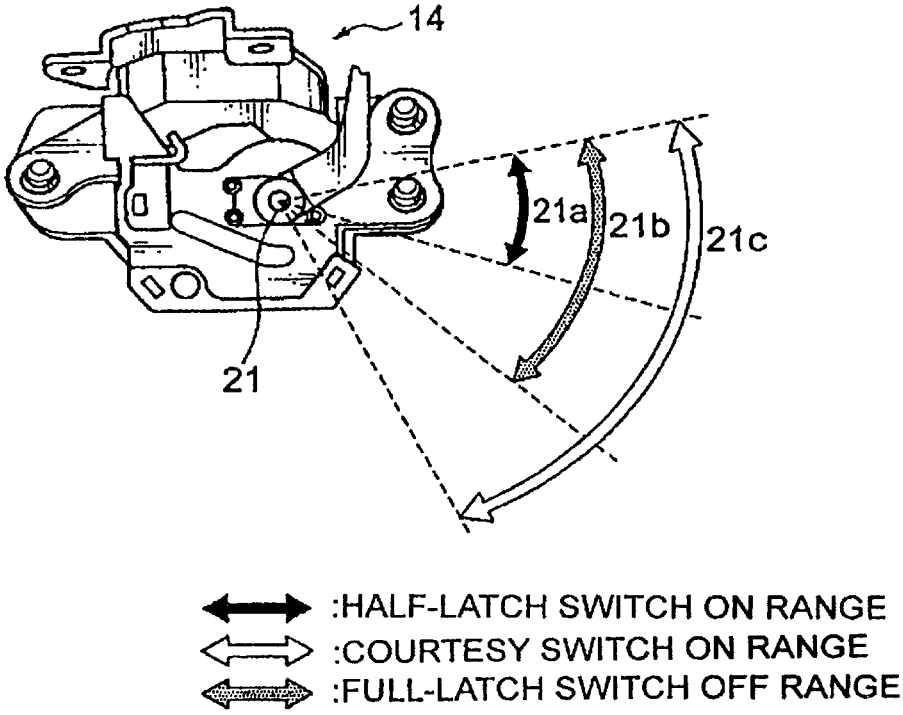
[FIG. 10] an explanatory view showing on/off ranges of the half-latch switch, the full-latch switch, and the courtesy switch.
Figure 11:
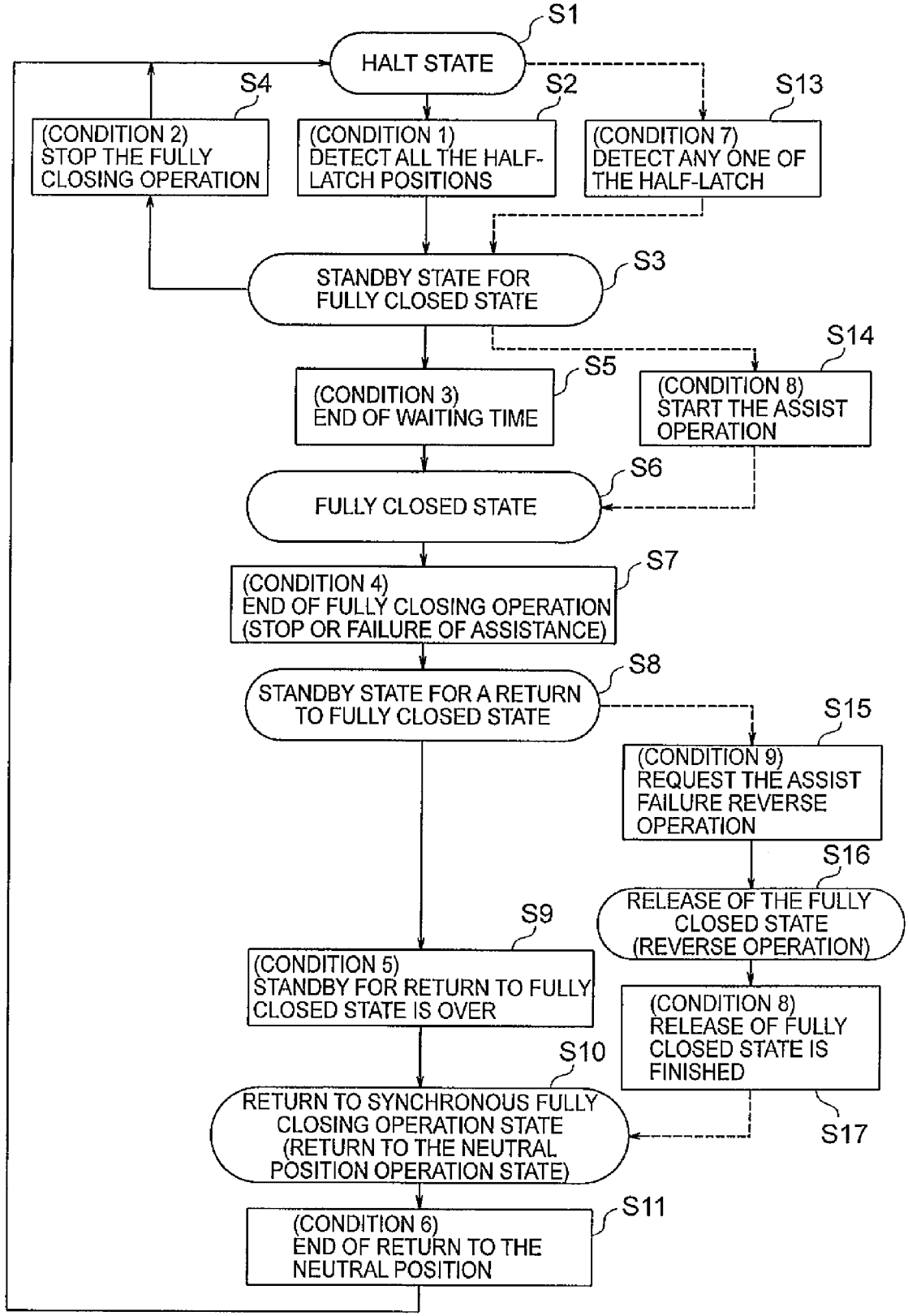
[FIG. 11] a state transition diagram explaining operations of the door open/close system for a vehicle according to a first embodiment of the present invention.
Figure 12:
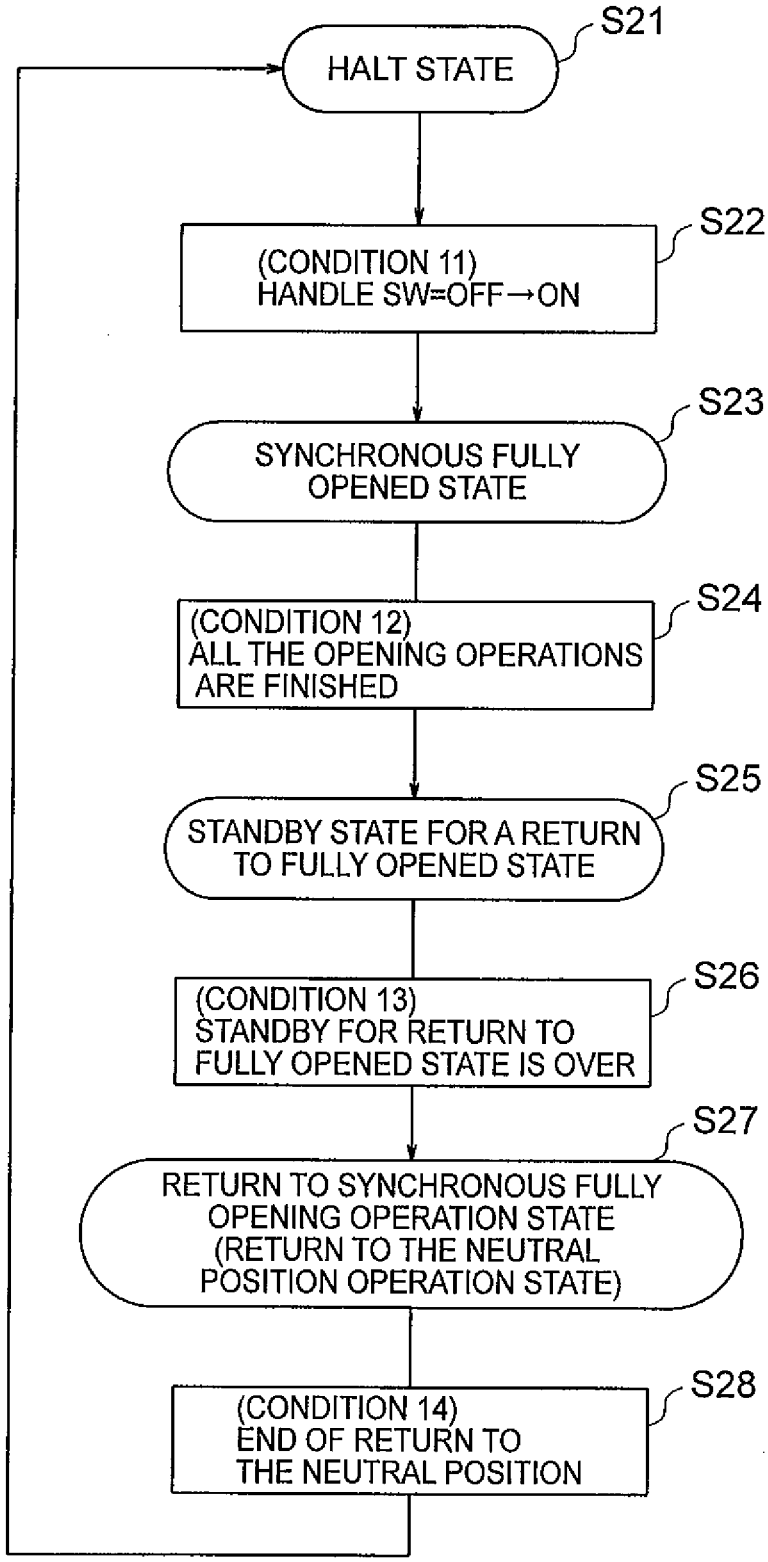
[FIG. 12] a state transition diagram explaining operations of the door open/close system for a vehicle according to the first embodiment of the present invention.
Figure 13B:
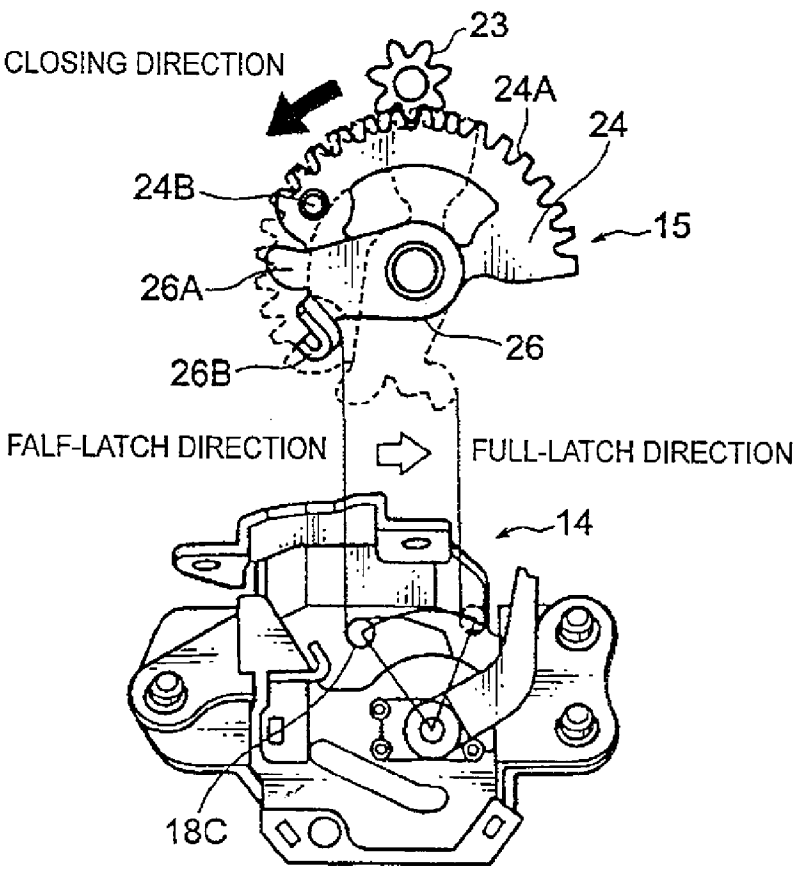
[FIG. 13B] an explanatory view showing the main part of the door open/close device moving from the fully opened state in the direction of closing the door.
Figure 13A:
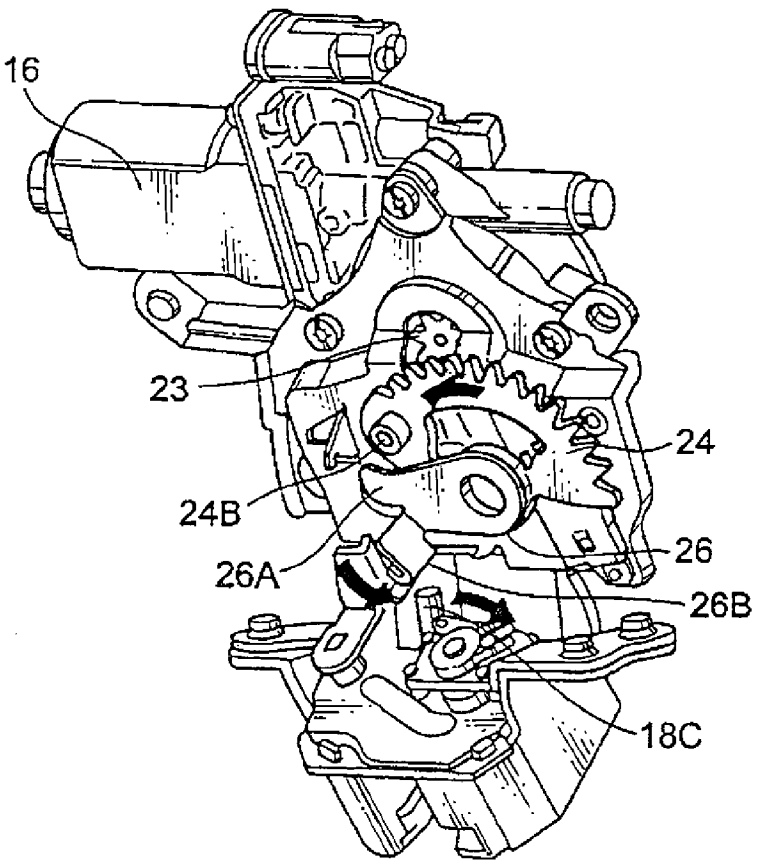
[FIG. 13A] an explanatory view showing a main part of the door open/close device moving from a fully opened state in a direction of closing the door.
Figure 14B:
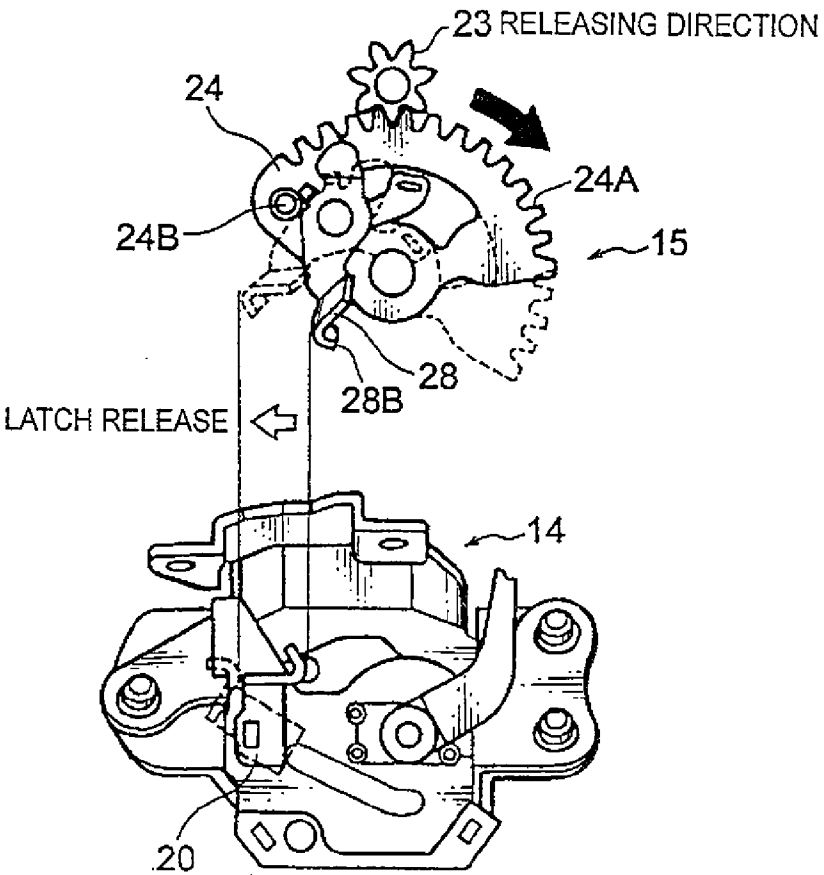
[FIG. 14B] an explanatory view showing the main part of the door open/close device moving from the fully closed state in the direction of opening the door.
Figure 14A:
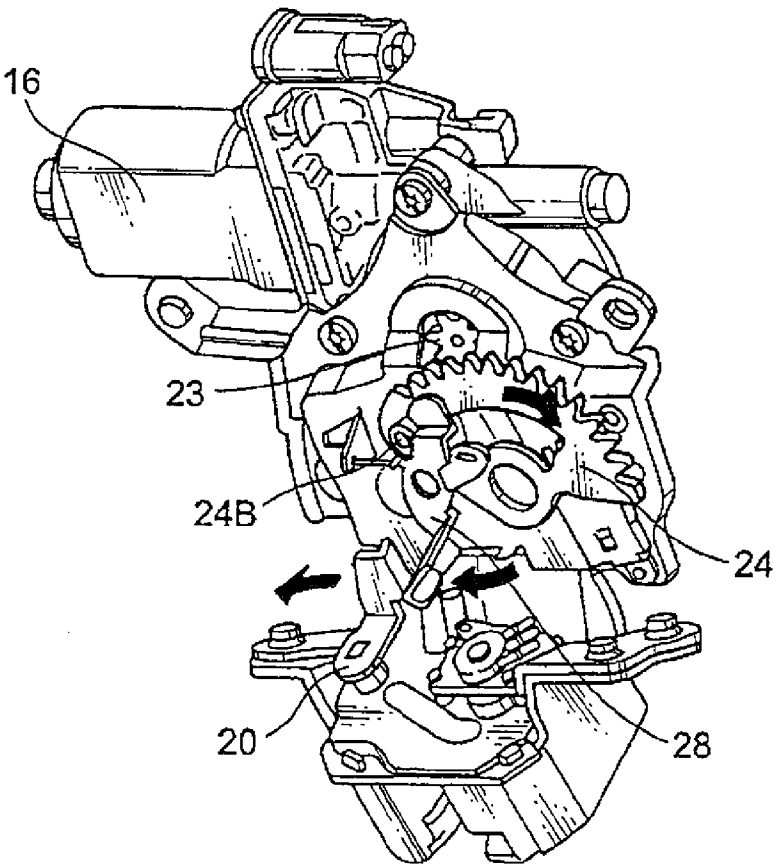
[FIG. 14A] an explanatory view showing the main part of the door open/close device moving from a fully closed state in a direction of opening the door.
Figure 15:
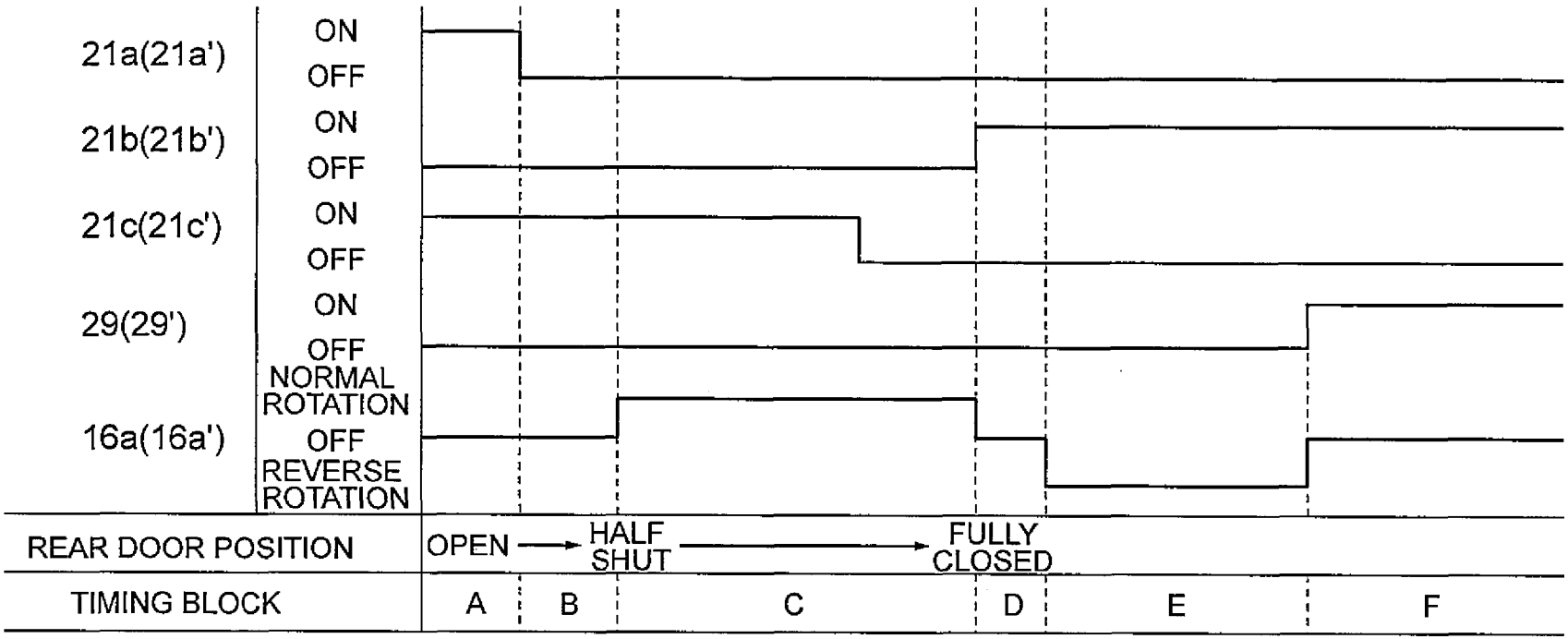
[FIG. 15] a timing chart of main parts of the door open/close device moving from the fully opened state in the direction of closing the door.
Figure 16:
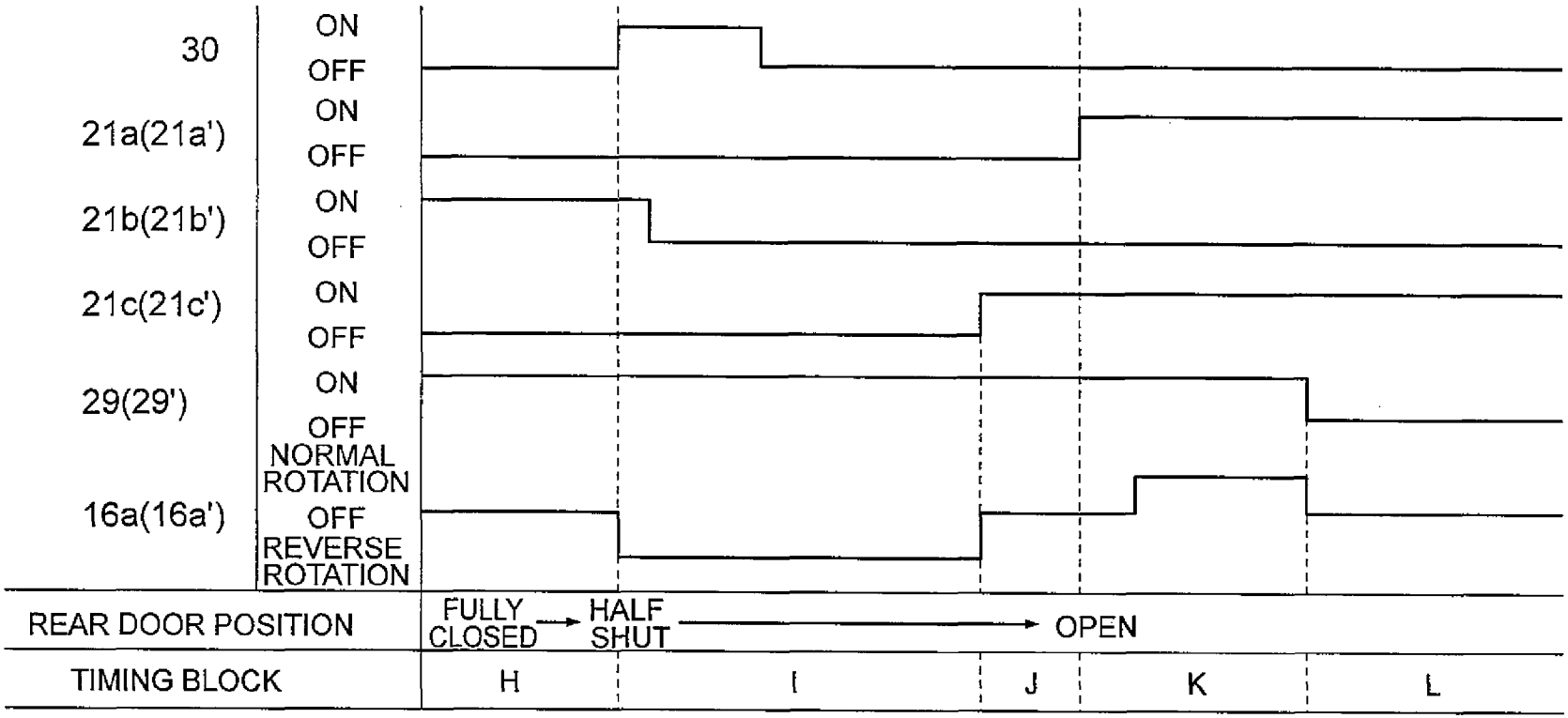
[FIG. 16] a timing chart of the main parts of the door open/close device moving from the fully closed state in the direction of opening the door.
Figure 17A:
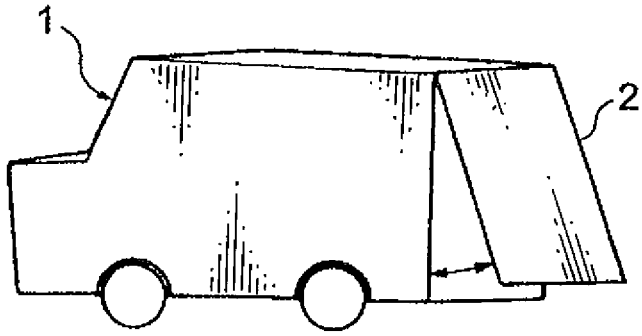
[FIG. 17A] an explanatory view showing a rear door of a conventional vehicle.
Figure 17B:
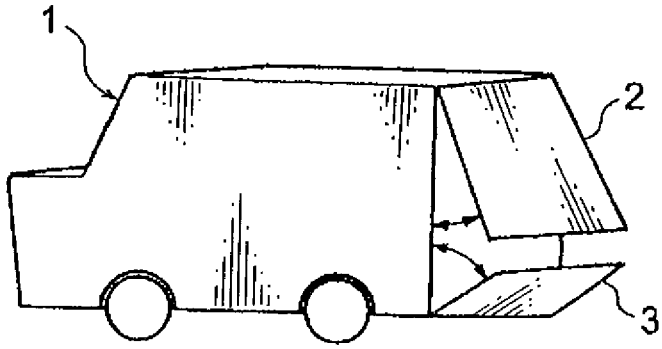
[FIG. 17B] an explanatory view showing a rear door of another conventional vehicle.
Figure 18:
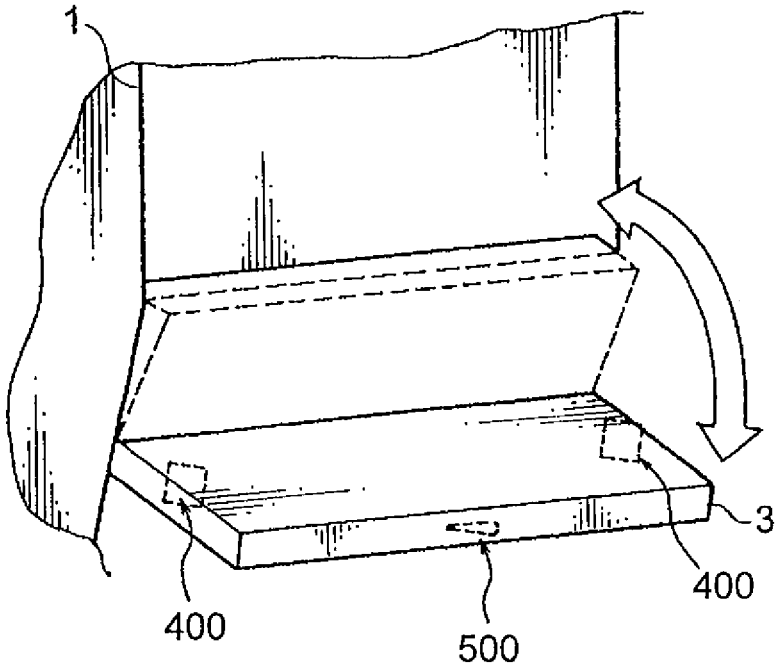
[FIG. 18] an explanatory view showing an arrangement of a locking mechanism of a conventional open/close system for a vehicle shown in FIG. 16B.
Figure 19:
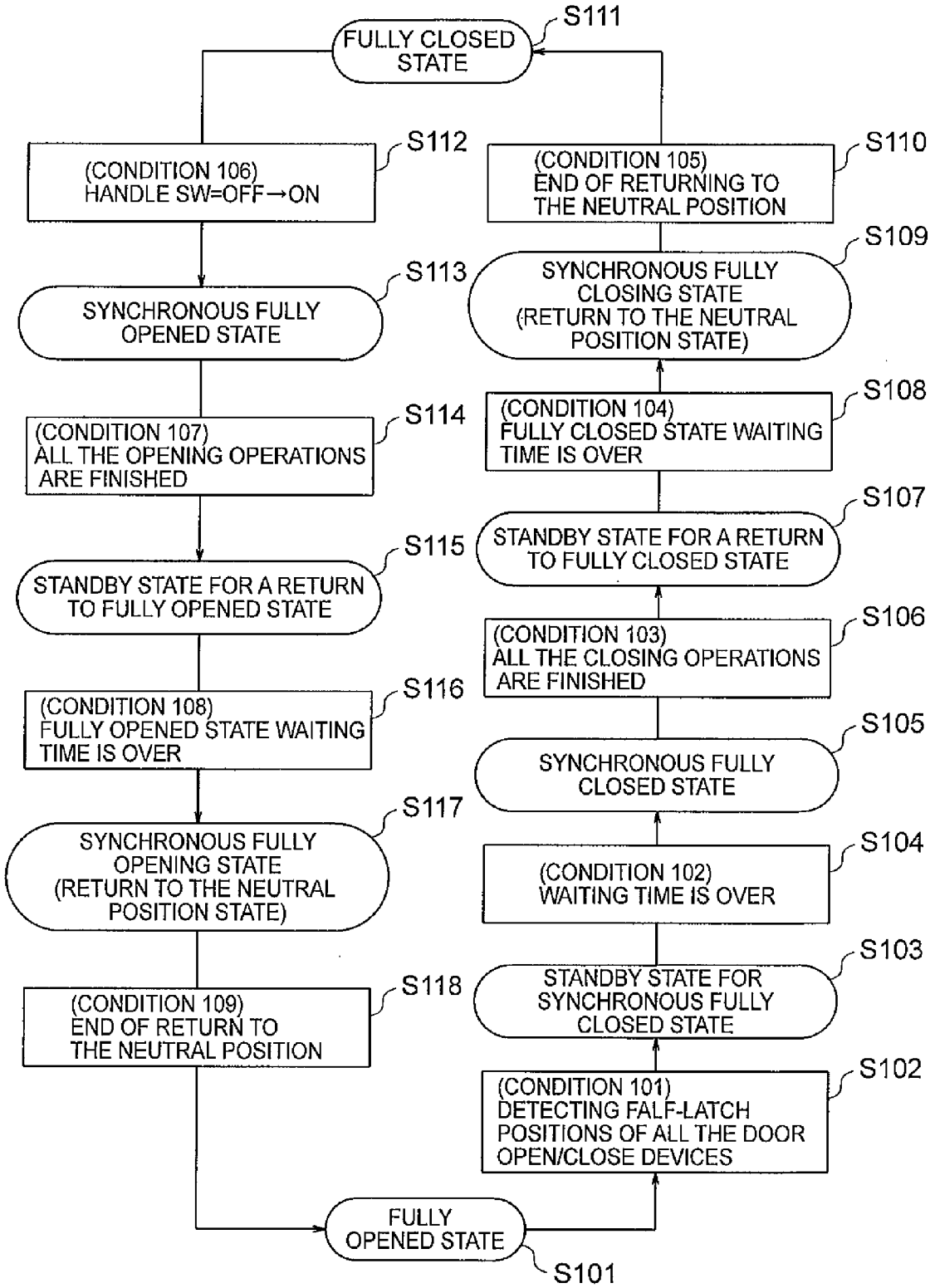
[FIG. 19] a state transition diagram explaining operations of the door open/close system for a vehicle according to a second embodiment of the present invention.

4 control unit (control member)
11, 11'door open/close device
12 striker
13 latch
14 latch mechanism
16*a*. 16*a'* motor
21, 21' latch switch (latch state detecting member)
30 handle switch (open instruction signal outputting member)

The invention claimed is:

1. A door closing system for a vehicle for fully closing a door, comprising:

a plurality of door open/close devices mounted on a door or a body of the vehicle, each of said door open /close devices having a latch mechanism for engaging with an engaging member mounted on the door or the body so as to be in a half-latch state or a full-latch state;

a motor for driving the latch mechanism;

a latch state detecting member for detecting if the latch mechanism is in a half-latch state or a full-latch state; and a control member including programmed instructions in a computer for automatically starting to:

drive synchronously all the motors of the door open/close devices to change the latch mechanisms from the half-latch state to the full-latch state only when in a first condition that all the latch state detecting members of the door open/close devices detect that the latch mechanisms are in the half-latch state in a case that the door of the vehicle is changed from a fully opened state to a fully closed state, and corresponding to this detection, drive the motor of any one of all the plurality of door open/close devices when in a second condition that the latch state detecting member of any one door open/close device, but not all the plurality of latch state detecting members of the door open/close devices, detects that the latch mechanism is in the half-latch state, and drive synchronously the motors of all the door open/close devices except the any one door open/close device to change all the latch mechanisms from the half-latch state to the full-latch state when, during the second condition, the latch state detecting members of all the door open/close devices detect that the latch mechanisms are in the half-latch state in a case that the door of the vehicle is changed from a fully opened state to a fully closed state.

2. A door closing system for a vehicle for fully closing a door, comprising:

a plurality of door open/close devices mounted on a door or a body of the vehicle, each of said door open/close devices having a latch mechanism for engaging with an engaging member mounted on the door or the body so as to be in a half-latch state or a full-latch state;

a motor for driving the latch mechanism;

a latch state detecting member for detecting if the latch mechanism is in a half-latch state or a full-latch state; and a control member including programmed instructions in a computer to:

drive synchronously all the motors of the door open/close devices to change the latch mechanisms from the half-latch state to the full-latch state only when in a first condition that all the latch state detecting members of the door open/close devices detect that the latch mechanisms are in the half-latch state in a case that the door of the vehicle is changed from a fully opened state to a fully closed state, and corresponding to this detection, and in a second condition, when the latch state detecting member of any one door open/close device, but not all the plurality of latch state detecting members of the door open/close devices, detects that the latch mechanism is in the half-latch state, start an assist operation to make all the latch mechanisms in the half-latch state by driving the motors of all the door open/close devices except the motor of the any one door open/close device.

3. The door closing system for a vehicle as claimed in claim 1, wherein when the motor of at least one of the other door open/close devices except said any one door open/close device is not started before the latch state detecting member of said any one door open/close device detects that the latch mechanism is in the full-latch state, the control member returns all the door open/close devices to the state previous to the start of driving of the motors.

4. The door closing system for a vehicle as claimed in claim 1 or claim 3, further comprising an open instruction signal outputting member for outputting an open instruction signal to the control member when the door is changed from the fully closed state to the fully opened state, wherein corresponding to an input of the open instruction signal from the open instruction signal outputting member, the control member synchronously starts driving all the motors of the door open/close devices to change each latch mechanism from the half-latch state to the full-latch state.

* * * * *